US008086150B2

(12) United States Patent
Yamada et al.

(10) Patent No.: US 8,086,150 B2
(45) **Date of Patent: *Dec. 27, 2011**

(54) TONER PARTICLE-BEARING ROLLER WITH PROJECTION PORTION, DEVELOPING DEVICE HAVING SUCH TONER PARTICLE-BEARING ROLLER, AND IMAGE FORMING APPARATUS HAVING SUCH DEVELOPING DEVICE

(75) Inventors: Yoichi Yamada, Shiojiri (JP); Tomohiro Aruga, Shiojiri (JP); Noboru Sakurai, Chino (JP)

(73) Assignee: Seiko Epson Corporation, Tokyo (JP)

( * ) Notice: Subject to any disclaimer, the term of this patent is extended or adjusted under 35 U.S.C. 154(b) by 1169 days.

This patent is subject to a terminal disclaimer.

(21) Appl. No.: 11/556,041

(22) Filed: Nov. 2, 2006

(65) Prior Publication Data

US 2007/0110481 A1 May 17, 2007

(30) Foreign Application Priority Data

| | | |
|---|---|---|
| Nov. 2, 2005 | (JP) | 2005-319930 |
| Nov. 2, 2005 | (JP) | 2005-319931 |
| Nov. 11, 2005 | (JP) | 2005-327781 |
| Nov. 25, 2005 | (JP) | 2005-340271 |
| Jan. 6, 2006 | (JP) | 2006-001479 |

(51) Int. Cl.
*G03G 15/08* (2006.01)

(52) U.S. Cl. ..... 399/279; 399/286

(58) Field of Classification Search ..... 399/279, 399/286

See application file for complete search history.

(56) References Cited

U.S. PATENT DOCUMENTS

| | | | | |
|---|---|---|---|---|
| 4,092,165 | A | 5/1978 | Jones | |
| 4,368,971 | A | 1/1983 | Watanabe et al. | |
| 4,780,741 | A | 10/1988 | Wada et al. | |
| 4,978,583 | A | 12/1990 | Wakui et al. | |
| 5,153,376 | A | 10/1992 | Tomita | |
| 5,339,141 | A * | 8/1994 | Suzuki et al. | 399/285 |
| 5,387,966 | A * | 2/1995 | Karashima | 399/286 |
| 5,391,135 | A | 2/1995 | Kuroki et al. | |
| 5,502,552 | A | 3/1996 | Iwata et al. | |
| 5,552,235 | A | 9/1996 | Bastawros et al. | |
| 5,600,417 | A | 2/1997 | Iguchi et al. | |
| 5,794,109 | A | 8/1998 | Ota et al. | |
| 5,797,827 | A | 8/1998 | Sondergeld | |

(Continued)

FOREIGN PATENT DOCUMENTS

EP 1372045 A2 12/2003

(Continued)

OTHER PUBLICATIONS

Machine translation of JP2004-034537.*

(Continued)

*Primary Examiner* — David Gray
*Assistant Examiner* — Andrew Do
(74) *Attorney, Agent, or Firm* — DLA Piper LLP (US)

(57) ABSTRACT

A developing device includes a toner particle-bearing roller that bears toner particles on its surface and develops a latent image borne by an image-bearing member with those toner particles, the toner particle-bearing roller has a projection portion disposed on its surface, the projection portion having a top surface having a flat portion, and a width of the top surface being equal to or more than a volume average particle diameter of the toner particles.

4 Claims, 23 Drawing Sheets

U.S. PATENT DOCUMENTS

| | | | | |
|---|---|---|---|---|
| 5,812,917 | A | 9/1998 | Iwata et al. | |
| 6,183,927 | B1 | 2/2001 | Magome et al. | |
| 6,201,942 | B1 | 3/2001 | Honda et al. | |
| 6,317,220 | B1 | 11/2001 | Fujita et al. | |
| 6,360,069 | B1 | 3/2002 | Mimura et al. | |
| 6,512,598 | B2 | 1/2003 | Fujita et al. | |
| 6,873,816 | B2 | 3/2005 | Akashi et al. | |
| 6,925,277 | B2 | 8/2005 | Sugihara | |
| 6,941,100 | B2 | 9/2005 | Yamada et al. | |
| 7,330,684 | B2 | 2/2008 | Okamoto | |
| 2005/0176566 | A1 | 8/2005 | Vestola et al. | |
| 2006/0056880 | A1 | 3/2006 | Okamoto | |
| 2006/0099011 | A1* | 5/2006 | Kamijo et al. | 399/239 |
| 2006/0111223 | A1 | 5/2006 | Chou | |
| 2007/0110481 | A1 | 5/2007 | Yamada et al. | |
| 2007/0110484 | A1* | 5/2007 | Yamada et al. | 399/286 |
| 2008/0298851 | A1 | 12/2008 | Yamada et al. | |
| 2008/0298852 | A1 | 12/2008 | Yamada et al. | |

FOREIGN PATENT DOCUMENTS

| | | | |
|---|---|---|---|
| JP | 55026526 | A | 2/1980 |
| JP | 59189374 | A | 10/1984 |
| JP | 61147264 | A | 7/1986 |
| JP | 63304277 | A | 12/1988 |
| JP | 01-102486 | | 4/1989 |
| JP | 02235080 | A | 9/1990 |
| JP | 04295871 | A | 10/1992 |
| JP | 05025459 | U | 4/1993 |
| JP | 05-142950 | | 6/1993 |
| JP | 06124043 | A | 5/1994 |
| JP | 06138774 | A | 5/1994 |
| JP | 07013410 | A | 1/1995 |
| JP | 08160736 | A | 6/1996 |
| JP | 08286497 | A | 11/1996 |
| JP | 08328376 | A | 12/1996 |
| JP | 09197800 | A | 7/1997 |
| JP | 10207172 | A | 8/1998 |
| JP | 11133728 | A | 5/1999 |
| JP | 11174821 | A | 7/1999 |
| JP | 2000242073 | A | 9/2000 |
| JP | 2000258989 | A | 9/2000 |
| JP | 2000275957 | A | 10/2000 |
| JP | 2001134069 | A | 5/2001 |
| JP | 2002112224 | A | 4/2002 |
| JP | 2002372855 | A | 12/2002 |
| JP | 2003057940 | A | 2/2003 |
| JP | 2003107905 | A | 4/2003 |
| JP | 2003208012 | A | 7/2003 |
| JP | 2003-263018 | | 9/2003 |
| JP | 2003316146 | A | 11/2003 |
| JP | 2004020581 | A | 1/2004 |
| JP | 2004034537 | A * | 2/2004 |
| JP | 2004212520 | A | 7/2004 |
| JP | 2005049649 | A | 2/2005 |
| JP | 2006259384 | A | 9/2006 |
| JP | 2006343542 | A | 12/2006 |
| JP | 2007121947 | A | 5/2007 |
| JP | 2007121950 | A | 5/2007 |
| JP | 2007121974 | A | 5/2007 |
| JP | 2007127800 | A | 5/2007 |
| JP | 4715451 | B2 | 7/2011 |

OTHER PUBLICATIONS

Extended European search report dated Feb. 4, 2011 for corresponding European application 08009803.1 lists the references above.

* cited by examiner

TONER PARTICLE-BEARING ROLLER WITH PROJECTION PORTION, DEVELOPING DEVICE HAVING SUCH TONER PARTICLE-BEARING ROLLER, AND IMAGE FORMING APPARATUS HAVING SUCH DEVELOPING DEVICE

CROSS-REFERENCE TO RELATED APPLICATIONS

The present application claims the priority of Japanese Patent Application No. 2005-319930 filed on Nov. 2, 2005, Japanese Patent Application No. 2005-319931 filed on Nov. 2, 2005, Japanese Patent Application No. 2005-327781 filed on Nov. 11, 2005, Japanese Patent Application No. 2005-340271 filed on Nov. 25, 2005, and Japanese Patent Application No. 2006-1479 filed on Jan. 6, 2006, which are herein incorporated by reference.

BACKGROUND

1. Technical Field

The present invention relates to toner particle-bearing rollers, developing devices and image forming apparatuses.

2. Related Art

Image forming apparatuses such as laser beam printers are well known. Such image forming apparatuses include, for example, an image-bearing member for bearing a latent image, and a developing device for developing the latent image borne by the image-bearing member with toner particles. When an image signal or the like is sent from an external device, such as a host computer, to such an image forming apparatus, the developing device is positioned at the developing position opposite the image-bearing member, a toner image is formed by developing the latent image borne by the image-bearing member with toner particles inside the developing device, and an image is ultimately formed on the medium by transferring this toner image onto the medium.

This developing device includes a toner particle-bearing roller, which bears toner particles on its surface and develops a latent image borne by the image-bearing member with the toner particles, in order to achieve the above-described function of developing the latent image borne by the image-bearing member.

Moreover, the developing devices are known in which projection portions are formed in the surface of the toner particle-bearing roller, in order to suitably bear the toner particles. However, if the surface of the toner particle-bearing roller is provided with projection portions, then forces may act locally from the projection portions on the toner particles, depending on the shape of the projection portions. For example, if the projection portions are sharp, then the forces from the projection portions may concentrate locally on the toner particles when the projection portions contact the toner particles. Thus, when the forces from the projection portions concentrate locally on the toner particles, these forces may cause a deformation of the toner particles and there is the risk that the toner particles may break.

Moreover, in order to suitably bear toner particles, the surface of the toner particle-bearing roller may be provided with depression portions having a flat bottom surface and lateral surfaces adjacent to that bottom surface. In this case, there is a risk that toner particles, especially finely particulate toner particles, accumulate at the boundaries between the bottom surface and the lateral surfaces.

Furthermore, toner particle-bearing rollers are known whose surface is provided with depression portions and projection portions that are arranged regularly. The developing of the latent image borne by the image-bearing member with toner particles that are borne on the surface of the toner particle-bearing roller is executed in a state in which the toner particle-bearing roller is in opposition to the image-bearing member, and at that time, a situation may occur in which the distance between the toner particles borne in the depression portions of the toner particle-bearing roller and the latent image borne by the image-bearing member is larger than the distance between the toner particles borne by the projection portions and the latent image. In this situation, the density of the toner image formed on the image-bearing member by the toner particles borne in the depression portions becomes lower than the density of the toner image formed on the image-bearing member by the toner particles borne in the projection portions, and there is the risk of density unevenness occurring in the toner image.

It should be noted that JP-A-2003-263018, JP-A-1-102486, and JP-A-5-142950 are examples of related technology.

SUMMARY

The present invention was arrived at in light of the above-described problems, and it is an object thereof to realize a developing device with which the deformation of toner particles can be suppressed.

A primary aspect of the present invention is a developing device as follows:

a developing device including, a toner particle-bearing roller that bears toner particles on its surface and develops a latent image borne by an image-bearing member with those toner particles, wherein the toner particle-bearing roller has a projection portion disposed on its surface, the projection portion having a top surface having a flat portion, and a width of the top surface being equal to or more than a volume average particle diameter of the toner particles.

Furthermore, the present invention was arrived at in light of the above-described problems, and it is an object thereof to realize the toner particle-bearing roller with which the accumulation of the toner particles can be suitably suppressed.

A primary aspect of this invention is the toner particle-bearing roller as follows:

A toner particle-bearing roller including, a depression portion disposed at its surface, the depression portion including a flat bottom surface and a lateral surface adjacent to the bottom surface and being provided at a boundary between the bottom surface and the lateral surface with a rounding having a radius of curvature equal to or more than half a volume average particle diameter of the toner particles.

Furthermore, the present invention was arrived at in light of the above-described problems, and it is an object thereof to suppress the occurrence of density irregularities in a toner image.

A primary aspect of this invention is a toner particle-bearing roller as follows:

A toner particle-bearing roller including, depression portions and projection portions that are arranged regularly at its surface, wherein a maximum value of a ten-point average roughness of the depression portions is smaller than a maximum value of a ten-point average roughness of the projection portions.

Other features of the present invention will become clear through the accompanying drawings and the following description.

BRIEF DESCRIPTION OF THE DRAWINGS

For a more complete understanding of the present invention and the advantages thereof, reference is now made to the following description taken in conjunction with the accompanying drawings.

DESCRIPTION OF EXEMPLARY EMBODIMENTS

Figure 1:
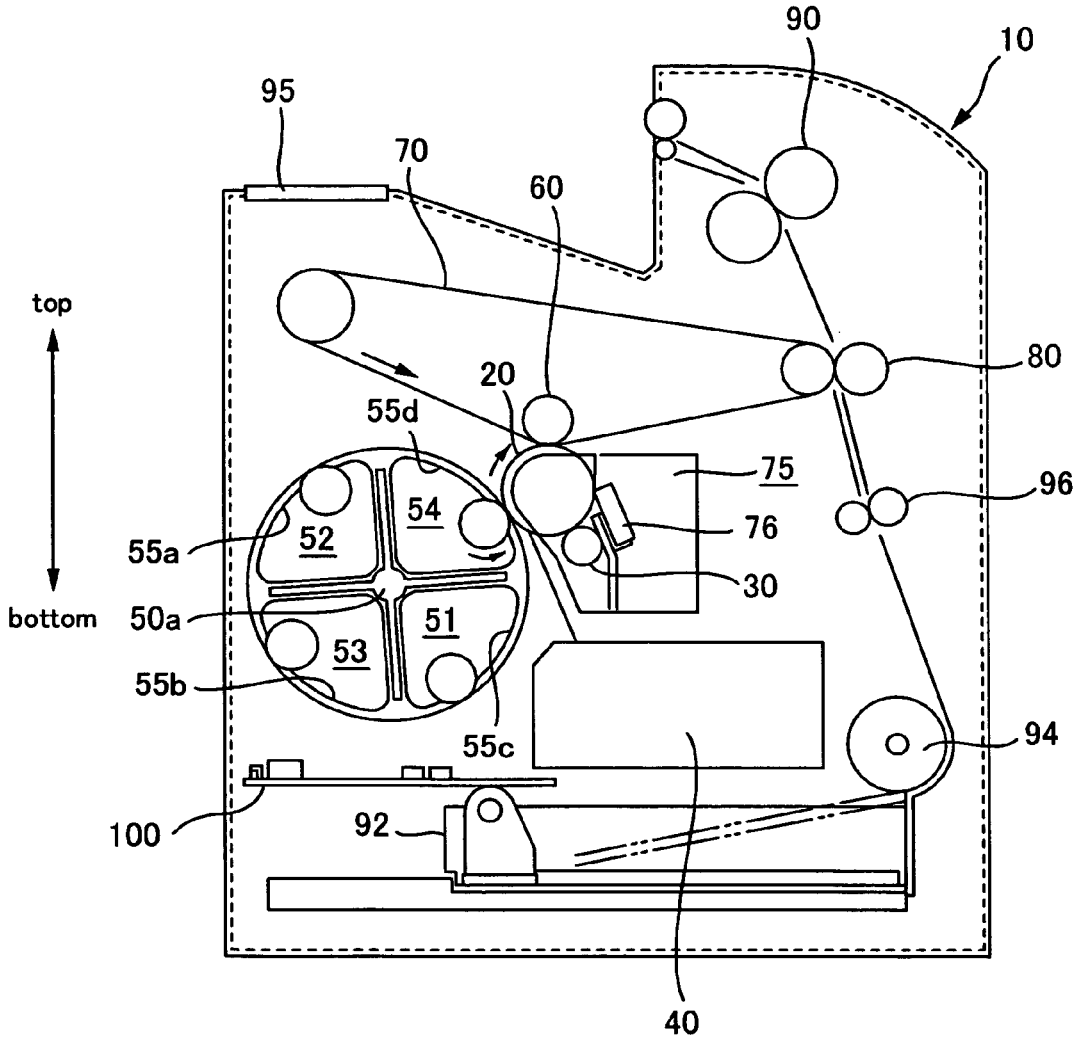
FIG. 1 is a diagram showing the main structural components constituting a printer 10.

At least the following matters will be made clear by the explanation in the present specification and the description of the accompanying drawings.

A developing device including, a toner particle-bearing roller that bears toner particles on its surface and develops a latent image borne by an image-bearing member with those toner particles, wherein the toner particle-bearing roller has a projection portion disposed on its surface, the projection portion having a top surface having a flat portion, and a width of the top surface being equal to or more than a volume average particle diameter of the toner particles.

With such a developing device, the top surface, which includes a flat portion and whose width is equal to or more than the volume average particle diameter of the toner particles, has the effect of dispersing the forces from the projection portions (top surfaces) on the toner particles when contacting the toner particles. Therefore, with above-described developing device, it is possible to suppress the forces from the projection portions to concentrate locally on the toner particles, and therefore, it is possible to suppress the deformation of the toner particles by such forces.

Moreover, the developing device may further have a layer thickness regulating member for regulating a layer thickness of the toner particles borne by the toner particle-bearing roller by contacting with the toner particle-bearing roller over a distance from a one end portion to the other end portion in an axial direction of the toner particle-bearing roller, wherein the layer thickness regulating member regulates the layer thickness by a planar surface of the layer thickness regulating member contacting with the toner particle-bearing roller.

If the layer thickness is regulated by contacting with the toner particle-bearing roller with the planar surface of the layer thickness regulating member, the toner particles are pressed towards the projection portions (top surfaces) by the layer thickness regulating member, therefore forces tend to act from the projection portions on the toner particles. For this reason, in the above case, the effect of providing the surface of the toner particle-bearing roller with projection portions having a top surface, that is, the effect of suppressing deformations of the toner particles, can be displayed more advantageously.

Moreover, the projection portion may have a lateral surface that is connected to the top surface, and a connection portion connecting the top surface with the lateral surface may be provided with a rounding.

If the connection portion connecting the top surface with the lateral surface is provided with a rounding, there is no edge in the connection portion, and therefore the forces acting from the connection portion on the toner particles can be reduced. Therefore, in the above case, deformations and the like of the toner particles can be suppressed.

Moreover, a radius of curvature of the rounding may be equal to or more than half a volume average particle diameter of the toner particles.

If the radius of curvature of the rounding is less than half the volume average particle diameter of the toner particles (that is, the average radius of the toner particles), then forces from the rounding may concentrate locally on the toner particles as the rounding cuts into the toner particles when the toner particles come into contact with the rounding. By contrast, if the radius of curvature of the rounding is equal to or more than half the volume average particle diameter of the toner particles, then there is no risk of the rounding cutting into the toner particles, so that the forces from the rounding on the toner particles are dispersed. Therefore, in the above-described case, deformations and the like of the toner particles can be suppressed.

Moreover, the surface may be provided with helical grooves that have an inclination with respect to an axial direction and a circumferential direction of the toner particle-bearing roller and are formed with an equal pitch in the axial direction, two kinds of grooves with different inclination angles may be provided, the projection portion may be provided surrounded by the two kinds of grooves, and a depth of the grooves may be equal to or less than twice a volume average particle diameter of the toner particles.

In this case, most of the toner particles positioned between the toner particle-bearing roller and the layer thickness regulating member in the grooves contact at least one of the toner particle-bearing roller and the layer thickness regulating member, and therefore the charge properties of the toner particles become appropriate.

Moreover, the surface may be provided with helical grooves that have an inclination with respect to the axial direction and the circumferential direction of the toner particle-bearing roller and are formed with an equal pitch in the axial direction, two kinds of grooves with different inclination angles may be provided, the projection portion may be surrounded by the two kinds of grooves, the latent image may include dot-shaped latent images that are formed in regions that are partitioned into a grid shape, the grid may be formed with a plurality of different pitches in the axial direction, and the pitch in the axial direction of the grooves may be smaller than the maximum pitch of a plurality of the different pitches of the grid.

In the surface of the toner particle-bearing roller, the amount of the toner particles borne by the grooves is larger than the amount of the toner particles borne outside the grooves. Therefore, when developing the latent image, there is the risk that the density becomes slightly higher at the positions facing the grooves. Accordingly, if the pitch in the axial direction of the grooves is larger than the maximum pitch of a plurality of kinds of the pitches in the grid, dots that are formed at portions including the grooves of the toner particle-bearing roller as well as dots that are formed at portions not including grooves are formed when the dot-shaped latent image formed in the region partitioned into the grid is developed. In this case, periodic density irregularities occur in the toner image obtained by developing the latent image. However, in accordance with the above-described developing device, all of the dots obtained by developing the dot-shaped latent image are formed at portions including the groove of the toner particle-bearing roller. Therefore, it is possible to suppress the occurrence of density irregularities due to grooves in the developed toner image.

An image forming apparatus including:

an image-bearing member for bearing a latent image; and a developing device having a toner particle-bearing roller that bears toner particles on its surface and develops the latent image borne by the image-bearing member with those toner particles, the toner particle-bearing roller having a projection portion disposed on its surface, the projection portion having a top surface having a flat portion, and a width of the top surface being equal to or more than a volume average particle diameter of the toner particle.

With such an image forming apparatus, the top surface, which includes a flat portion and whose width is equal to or more than the volume average particle diameter of the toner particles, has the effect of dispersing the forces from the projection portions (top surfaces) on the toner particles when contacting the toner particles. Therefore, with the above-described image forming apparatus, it is possible to suppress the forces from the projection portions to concentrate locally on the toner particles, and therefore, it becomes possible to suppress the deformations and the like of the toner particles by such forces.

A developing device including, a toner particle-bearing roller that bears toner particles on its surface and develops a latent image borne by an image-bearing member with those toner particles, wherein the toner particle-bearing roller has a projection portion disposed on its surface, the projection portion including a rounding at least at a tip section of the projection portion, the radius of curvature of the rounding being equal to or more than half a volume average particle diameter of the toner particles.

With such a developing device, there is the effect of dispersing the forces acting from the projection portions (rounding) on the toner particles when the rounding contacts the toner particles. Therefore, with the above-described developing device, it is possible to suppress the forces from the projection portions to concentrate locally on the toner particles, and therefore, it becomes possible to suppress the deformation and the like of the toner particles by such forces.

A toner particle-bearing roller including, a depression portion disposed at its surface, the depression portion each including a flat bottom surface and a lateral surface adjacent to the bottom surface and being provided at a boundary between the bottom surface and the lateral surface with a rounding having a radius of curvature equal to or more than half a volume average particle diameter of toner particles.

In this case, it becomes possible to realize a toner particle-bearing roller with which the accumulation of toner particles is suitably suppressed.

Furthermore, the toner particle-bearing roller may further include a non-depression portion adjacent to the lateral surface on a side opposite to the bottom surface, wherein a rounding having the radius of curvature equal to or more than half a volume average particle diameter of the toner particles may be provided at a boundary between the non-depression portion and the lateral surface.

In this case, the force acting on the toner particle at the boundary between the non-depression portion and lateral surface adjacent to the flat bottom surface is dispersed, therefore, deformations of the toner particle can be suppressed.

A developing device including, a toner particle-bearing roller including a depression portion disposed at its surface, the depression portion including a flat bottom surface and a lateral surface adjacent to the bottom surface and being provided at a boundary between the bottom surface and the lateral surface with a rounding having a radius of curvature equal to or more than half a volume average particle diameter of toner particles.

In this case, it becomes possible to realize a developing device with which the accumulation of toner particles is suitably suppressed.

A toner particle-bearing roller including, a depression portion disposed at its surface, the depression portion having a first lateral surface and a second lateral surface including a planar slanted portion and opposing each other, the first lateral surface and the second lateral surface being adjacent at a lower section of the depression portion, and a boundary between the first lateral surface and the second lateral surface at the lower section being provided with a rounding whose radius of curvature is equal to or more than half a volume average particle diameter of toner particles.

In this case, it becomes possible to realize a toner particle-bearing roller with which the accumulation of toner particles is suitably suppressed.

Furthermore, the first lateral surface of the depression portion and a third lateral surface of another depression portion adjacent to that depression portion may be adjacent at an upper section of the depression portion and the other depression portion, and the boundary between the first lateral surface and the third lateral surface may be provided with a rounding whose radius of curvature is equal to or more than half a volume average particle diameter of the toner particles.

In this case, the forces acting on the toner particles at the boundary between the first lateral surface and the third lateral surface are dispersed, and therefore the deformation of the toner particles can be suppressed.

A developing device including, a toner particle-bearing roller including, a depression portion disposed at its surface, the depression portion having a first lateral surface and a second lateral surface, each including a planar slanted portion and opposing each other, wherein the first lateral surface and the second lateral surface are adjacent at a lower section of the depression portion, and a boundary between the first lateral surface and the second lateral surface at this lower section is provided with a rounding whose radius of curvature is equal to or more than half a volume average particle diameter of toner particles.

In this case, it becomes possible to realize a developing device with which the accumulation of toner particles is suitably suppressed.

A toner particle-bearing roller including, depression portions and projection portions that are arranged regularly at its surface, wherein a maximum value of a ten-point average roughness of the depression portions is smaller than a maximum value of a ten-point average roughness of the projection portions.

With this toner particle-bearing roller, it is possible to suppress the occurrence of density irregularities in the toner image.

Furthermore, the ten-point average roughness of the projection portions may be made maximal when a direction along an axial direction of the toner particle-bearing roller is taken as a direction of an average line of a roughness curve when determining the ten-point average roughness.

Furthermore, the ten-point average roughness of the projection portions may be made minimal when a direction along a circumferential direction of the toner particle-bearing roller is taken as the direction of the average line of the roughness curve when determining the ten-point average roughness.

In this case, it is possible to improve the transfer properties of the toner particles.

Furthermore, it is also possible that the maximum value of the ten-point average roughness of the projection portions is equal to or less than a volume average particle diameter of toner particles.

In this case, it is possible to improve the transfer properties of the toner particles even more.

A developing device including, a toner particle-bearing roller including depression portions and projection portions that are arranged regularly at a surface of the toner particle-bearing roller, wherein a maximum value of a ten-point average roughness of the depression portions is smaller than a maximum value of a ten-point average roughness of the projection portions.

With this developing device, it is possible to suppress the occurrence of density irregularities in the toner image.

A developing device including, a toner particle-bearing roller having a plurality of projection portions at its surface for bearing toner particles for developing a latent image, wherein the toner particles are supplied to the toner particle-bearing roller by a porous foamed member, and an average distance, with respect to an axial direction of the toner particle-bearing roller, between apertures of pores is smaller than a maximum width, with respect to the axial direction, of top surfaces of the projection portions.

With this developing device, it is possible to prevent the occurrence of empty spaces in the developed toner image and generating locations where the density is low.

Overall Configuration Example of Image-Forming Apparatus

Next, using FIG. 1, an outline of a laser beam printer (hereinafter, also referred to as "printer") 10 serving as an example of an image forming apparatus is described. FIG. 1 is a diagram showing the main structural components constituting the printer 10. It should be noted that in FIG. 1, the vertical direction is indicated by the arrows, and, for example, a paper supply tray 92 is arranged at a lower section of the printer 10 and a fixing unit 90 is arranged at an upper section of the printer 10.

Configuration Example of the Printer 10

As shown in FIG. 1, the printer 10 according to this embodiment includes a charging unit 30, an exposing unit 40, a YMCK developing unit 50, a primary image transfer unit 60, an intermediate transfer member 70, and a cleaning unit 75. These units are arranged in the direction of rotation of a photoconductor 20, which serves as an example of an image-bearing member. The printer 10 further includes a secondary transfer unit 80, a fixing unit 90, a display unit 95 constituted by a liquid-crystal panel and serving as a means for displaying notifications to the user, and a control unit 100 for controlling these units and managing the operations of the printer.

The photoconductor 20 has a hollow cylindrical conductive base and a photoconductive layer formed on the outer peripheral surface of the conductive base, and is rotatable about its central axis. In this embodiment, the photoconductor 20 rotates clockwise, as shown by the arrow in FIG. 1.

The charging unit 30 is a device for charging the photoconductor 20. The exposing unit 40 is a device for forming a latent image on the charged photoconductor 20 by irradiating a laser beam thereon. The exposing unit 40 includes, for example, a semiconductor laser for irradiating a laser beam, a polygon mirror unit rotating a polygon mirror, and lenses of multiple types, such as an F-θ lens, and irradiates a modulated laser beam onto the charged photoconductor 20, in accordance with image signals that have been input from a host computer (not shown in the drawings) such as a personal computer or a word processor. The laser beam that is emitted from the semiconductor laser at that time is irradiated onto the polygon mirror. After passing through the lenses, the laser beam irradiated onto the polygon mirror is scanned across the photoconductor 20, while its reflection angle is being changed by the rotation of the polygon mirror. Thus, by turning the laser beam on and off at a predetermined timing, dot-shaped latent images are formed in a region partitioned into a grid on the photoconductor 20, which rotates at a predetermined speed. These dot-shaped images constitute the latent image. Here, the dot-shaped latent images form the latent image so that they cannot be discerned by the naked eye.

The YMCK developing unit 50 is a device for developing the latent image formed on the photoconductor 20 using toner particles (also simply referred to as "toner T" below) contained in developing devices, that is, a black (K) toner contained in a black developing device 51, a magenta (M) toner contained in a magenta developing device 52, a cyan (C) toner contained in a cyan developing device 53, and a yellow (Y) toner contained in a yellow developing device 54.

By rotating the YMCK developing unit 50 in a state in which the four developing devices 51, 52, 53, and 54 are mounted, it is possible to move the positions of these four developing devices 51, 52, 53, and 54. More specifically, the YMCK developing unit 50 holds the four developing devices 51, 52, 53, and 54 with four holding sections 55*a*, 55*b*, 55*c*, and 55*d*. The four developing devices 51, 52, 53, and 54 can be rotated around a central shaft 50*a*, while maintaining their relative positions. Every time the image formation corresponding to one page is finished, a different one of the developing units is caused to selectively oppose the photoconductor 20, thereby successively developing the latent image formed on the photoconductor 20 with the toner T contained in each of the developing units 51, 52, 53, and 54. It should be noted that each of the four developing devices 51, 52, 53, and 54 can be removed from the holding sections of the YMCK developing unit 50. Furthermore, the developing devices are described in detail further below.

The primary image transfer unit 60 is a device for transferring a single color toner image formed on the photoconductor 20 to the intermediate image transfer member 70. When the four toner colors are successively transferred over one another, a full color toner image is formed on the intermediate image transfer member 70.

The intermediate image transfer member 70 is a layered endless belt made by providing a tin vapor deposition layer on the surface of a PET film and forming a semiconductive coating on its surface. The intermediate image transfer member 70 is driven to rotate at substantially the same circumferential speed as the photoconductor 20.

The secondary image transfer unit 80 is a device for transferring the single-color toner image or the full-color toner image formed on the intermediate image transfer member 70 onto a medium such as paper, film, or cloth.

The fixing unit 90 is a device for fusing the single-color toner image or the full-color toner image, which has been transferred to the medium, onto the medium to turn it into a permanent image.

The cleaning unit 75 is a device that is provided between the primary image transfer 60 and the charging unit 30, has a rubber cleaning blade 76 contacting against the surface of the photoconductor 20, and is for removing the toner T remaining on the photoconductor 20 by scraping it off with the cleaning blade 76 after the toner image has been transferred onto the intermediate image transfer member 70 by the primary image transfer unit 60.

Figure 2:
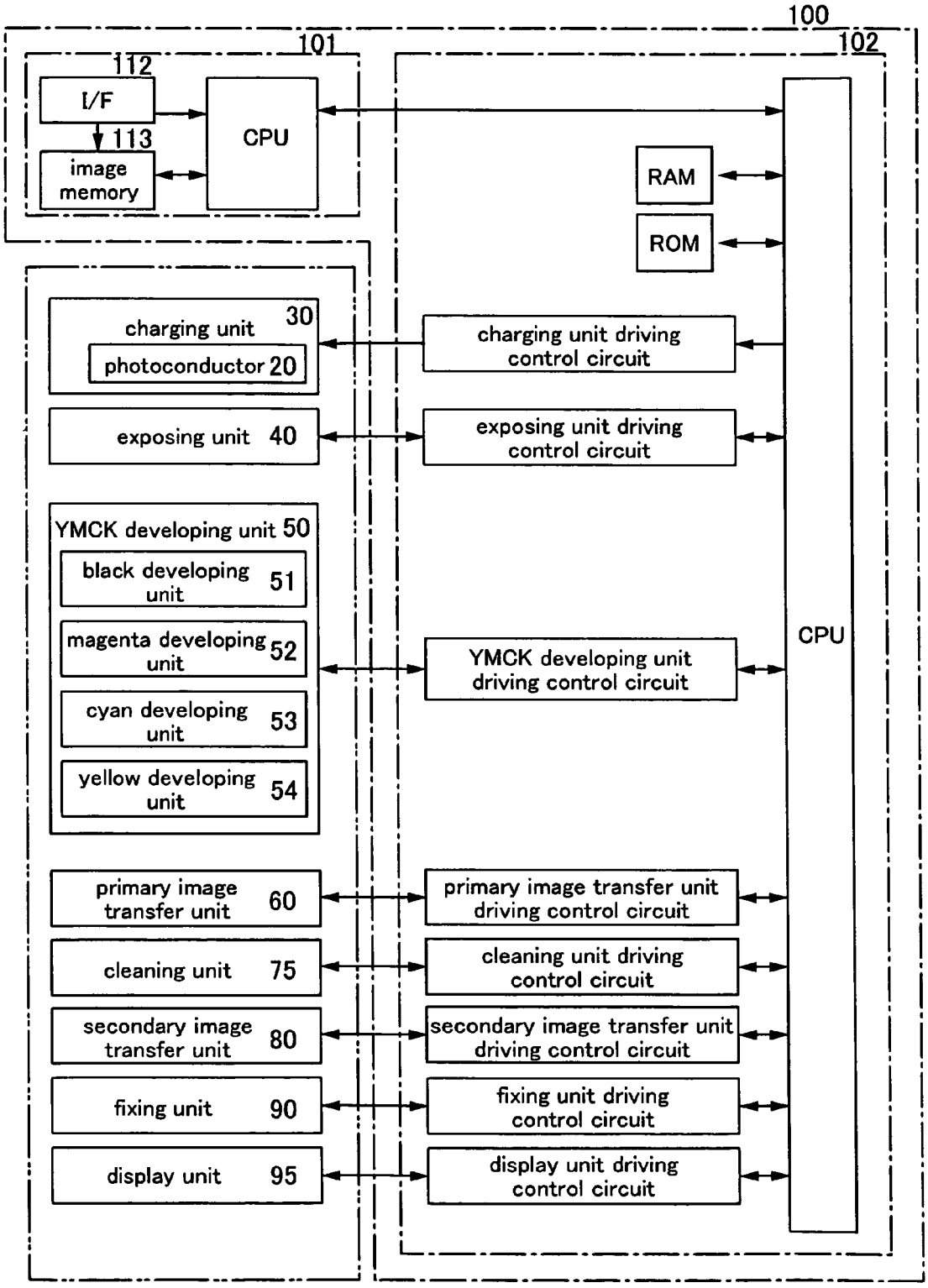
FIG. 2 is a block diagram showing a control unit of the printer 10 in FIG. 1.

The control unit 100 includes a main controller 101 and a unit controller 102, as shown in FIG. 2. An image signal and a control signal are input into the main controller 101, and in accordance with a command based on the image signal and the control signal, the unit controller 102 controls each of the units and the like to form the image.

Operation Example of the Printer 10

Next, the operation of the printer 10 configured as above is described.

First, when an image signal and a control signal from a host computer (not shown in the drawings) are input to the main controller 101 of the printer 10 via an interface (I/F) 112, the photoconductor 20 and the intermediate image transfer body 70 are rotated under the control of the unit controller 102 in accordance with a command from the main controller 101. While rotating, the photoconductor 20 is successively charged by the charging unit 30 at a charging position.

The region of the photoconductor 20 that has been charged is brought to an exposure position through rotation of the photoconductor 20, and a latent image corresponding to image information of a first color, for example yellow Y, is formed in that region by the exposing unit 40. Also, the YMCK developing unit 50 positions the yellow developing device 54, which contains yellow (Y) toner, at the developing position opposing the photoconductor 20.

The latent image formed on the photoconductor 20 is brought to the developing position through the rotation of the photoconductor 20, and is developed with yellow toner by the yellow developing device 54. Thus, a yellow toner image is formed on the photoconductor 20.

The yellow toner image that is formed on the photoconductor 20 is brought to the primary image transfer position through rotation of the photoconductor 20 and is transferred to the intermediate image transfer member 70 by the primary image transfer unit 60. At this time, a primary image transfer voltage, which has an opposite polarity to the polarity to which the toner T is charged, is applied to the primary image transfer unit 60. It should be noted that, during this process, the photoconductor 20 and the intermediate image transfer member 70 are in contact, whereas the secondary image transfer unit 80 is kept separated from the intermediate image transfer member 70.

By sequentially executing the above-described processes with each of the developing devices for the second, the third, and the fourth color, toner images in four colors corresponding to the respective image signals are transferred to the intermediate image transfer member 70 in a superimposed manner. Thus, a full color toner image is formed on the intermediate image transfer member 70.

With the rotation of the intermediate image transfer member 70, the full-color toner image formed on the intermediate image transfer member 70 reaches a secondary image transfer position, and is transferred onto the medium by the secondary image transfer unit 80. It should be noted that the medium is carried from the paper supply tray 92 to the secondary image transfer unit 80 via the paper supply roller 94 and the registration rollers 96. Also, when performing the image transfer operation, the secondary image transfer unit 80 is pressed against the intermediate image transfer member 70 while applying a secondary image transfer voltage to it.

The full-color toner image transferred onto the medium is heated and pressurized by the fixing unit 90 and thus fused to the medium.

On the other hand, after the photoconductor 20 has passed the primary image transfer position, the toner T adhering to the surface of the photoconductor 20 is scraped off by the cleaning blade 76 that is supported by the cleaning unit 75, and the photoconductor 20 is charged in order to form the next latent image. The scraped-off toner T is collected in a remaining-toner collector of the cleaning unit 75.

Overview of the Control Unit

The configuration of the control unit 100 is described next, with reference to FIG. 2. The main controller 101 of the control unit 100 is electrically connected to the host computer via an interface 112, and is provided with an image memory 113 for storing image signals input into it from the host computer. The unit controller 102 is electrically connected to each of the units of the apparatus body (i.e., the charging unit 30, the exposing unit 40, the YMCK developing unit 50, the primary image transfer unit 60, the cleaning unit 75, the secondary image transfer unit 80, the fixing unit 90, and the display unit 95), detects the state of each of the units by receiving signals from sensors provided in those units, and controls each of the units in accordance with the signals that are input from the main controller 101.

Outline of Developing Device

Figure 3:
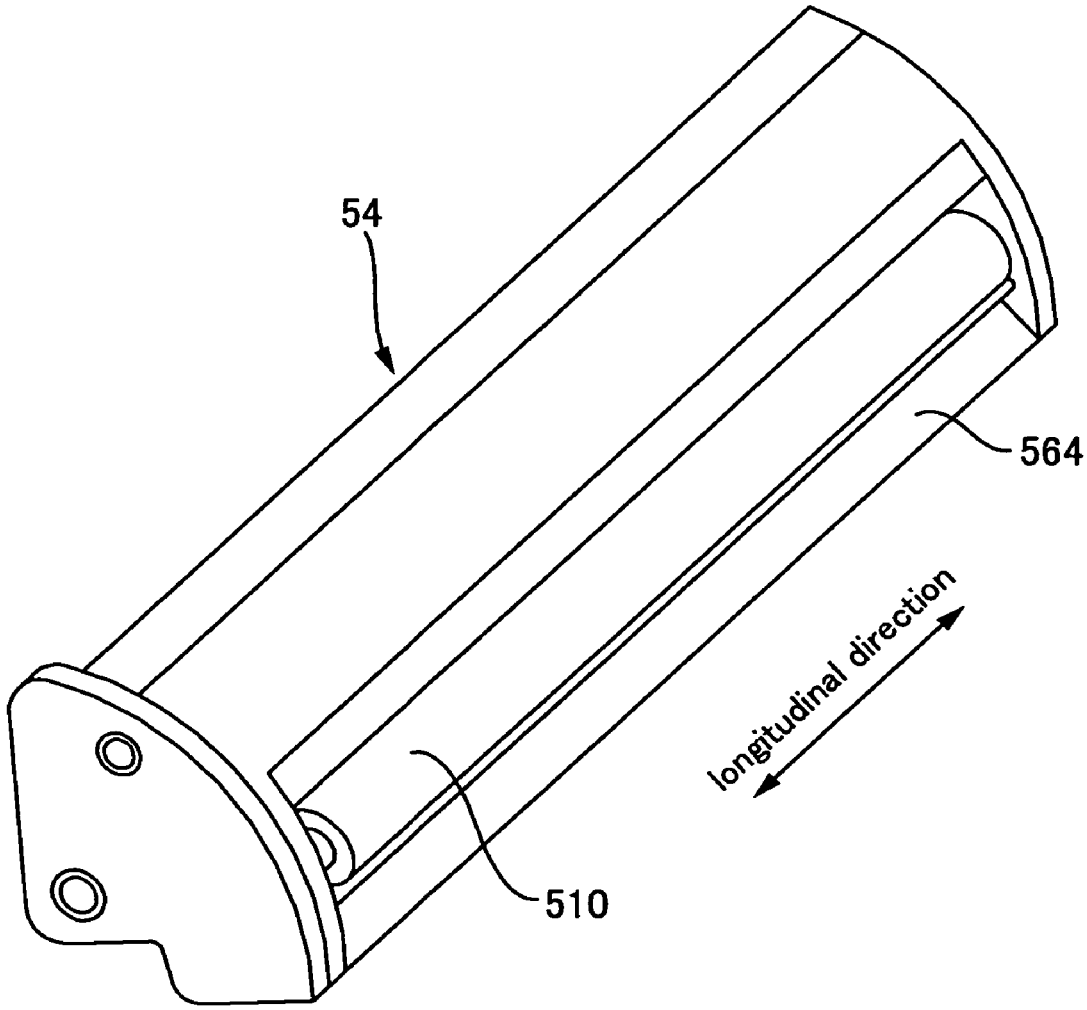
FIG. 3 shows a conceptual diagram of a developing device.
Figure 4:
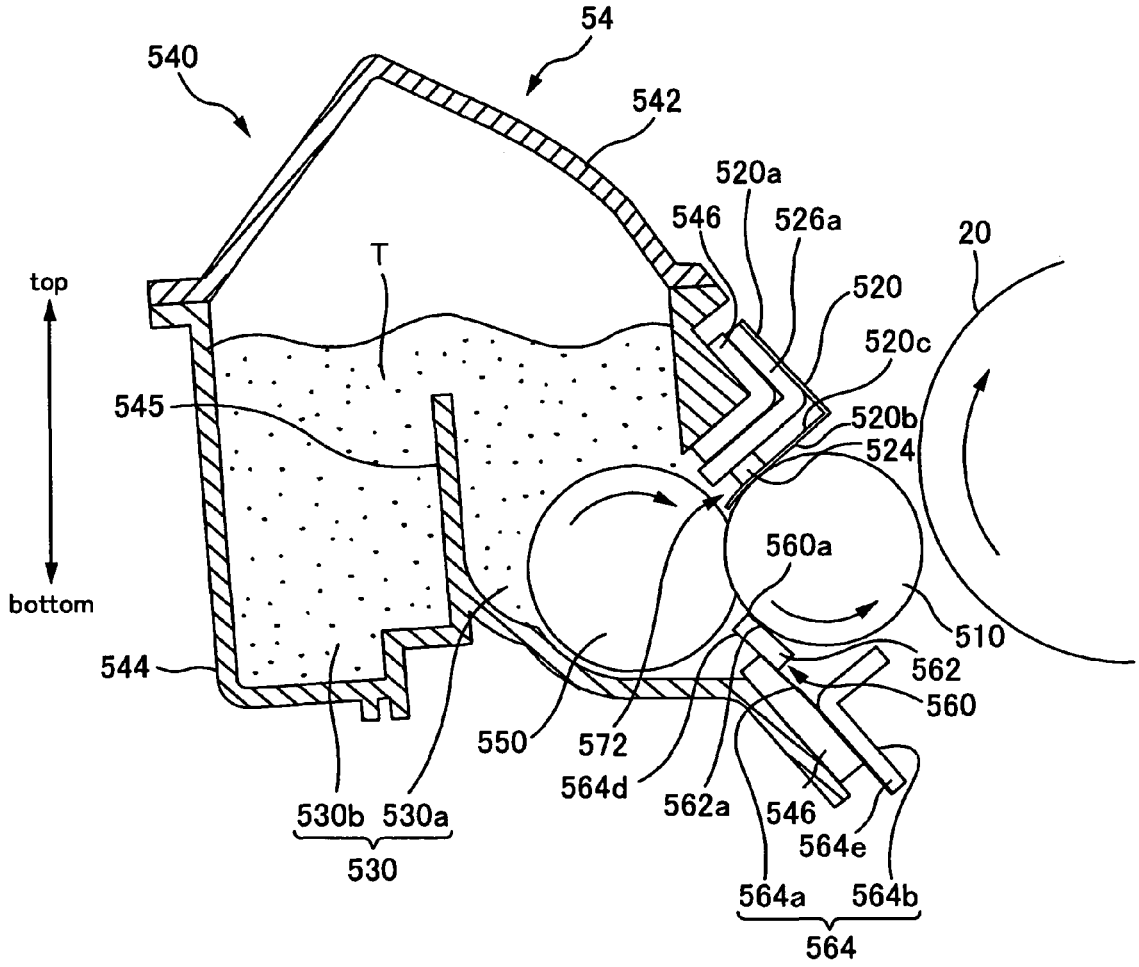
FIG. 4 is a cross-sectional view showing the main structural components of this developing device.

Next, a configuration example and an operation example of the developing device are described with reference to FIG. 3 and FIG. 4. FIG. 3 shows a conceptual diagram of a developing device. FIG. 4 is a cross-sectional view showing the main structural components of this developing device. It should be noted that the cross-sectional view shown in FIG. 4 shows a cross section of the developing device taken along a plane perpendicular to the longitudinal direction shown in FIG. 3. Moreover, in FIG. 4, like in FIG. 1, the vertical direction is indicated by arrows, and for example the center axis of the developing roller 510 is located lower than the center axis of the photoconductor 20. Also, in FIG. 4, the yellow developing device 54 is shown in the state that it is positioned at the developing position, which is in opposition to the photoconductor 20.

The YMCK developing unit 50 is provided with the black developing device 51 containing black (K) toner, the magenta developing device 52 containing magenta (M) toner, the cyan developing device 53 containing cyan (C) toner, and the yellow developing device 54 containing yellow (Y) toner. However, since the configuration of each of the developing devices is the same, hereinafter, only the yellow developing device 54 will be explained.

Configuration Example of the Developing Device

The yellow developing device 54 includes a developing roller 510, as an example of a toner particle-bearing roller, an upper seal 520, a toner container 530, a housing 540, a toner supplying roller 550, and a restriction blade 560, as an example of layer thickness restricting member, and the like.

The developing roller 510 bears toner particles (toner T) on its surface and is for developing the latent image borne by the photoconductor 20 with the toner particles. The developing roller 510 is a member made of an aluminum alloy, an iron alloy or the like. The surface of the developing roller 510 is provided with depression portions 518, as examples of grooves, and with projection portions 519 (see FIG. 6). The surface shape of the developing roller 510 is described later in more detail.

Further, as shown in FIG. 3, the developing roller 510 is supported at both end portions in the longitudinal direction of the developing device (the axial direction of the developing roller 510) and is rotatable around its central axis. As shown in FIG. 4, the developing roller 510 rotates in a direction (the counterclockwise direction in FIG. 4) that is opposite to the rotation direction of the photoconductor 20 (the clockwise direction in FIG. 4). Its center axis is located lower than the center axis of the photoconductor 20.

Moreover, in the state in which the yellow developing device 54 opposes the photoconductor 20, there is a gap between the developing roller 510 and the photoconductor 20. That is to say, the yellow developing device 54 develops the latent image formed on the photoconductor 20 in a non-contacting manner. It should be noted that during the development of the latent image formed on the photoconductor 20, an alternating electric field is formed between the developing roller 510 and the photoconductor 20.

The housing 540 is manufactured by welding together a plurality of integrally-molded housing sections made of resin, that is, an upper housing section 542 and a lower housing section 544. A toner containing member 530 for containing toner T is formed inside the housing 540. The toner containing member 530 is divided by a partitioning wall 545 for partitioning the toner T, which protrudes inwards (in the vertical direction of FIG. 4) from the inner wall, into two toner containing sections, namely, a first toner containing section 530*a* and a second toner containing section 530*b*.

The first toner containing section 530*a* and the second toner containing section 530*b* are in communication at the top, and in the state shown in FIG. 4, the movement of toner T is regulated by the partitioning wall 545. However, when the YMCK developing unit 50 rotates, the toner contained in the first toner containing section 530*a* and the second toner containing section 530*b* is temporarily collected on the side where the top sides are in communication in the developing position, and when it returns to the state shown in FIG. 4, the toner is mixed and returned to the first toner containing section 530*a* and the second toner containing section 530*b*. That is to say, by rotating the YMCK developing unit 50, the toner T in the developing devices is suitably stirred.

Therefore, in this embodiment, the toner containing member 530 is not provided with a stirring member, however it is also possible to provide a stirring member for stirring the toner T contained in the toner containing member 530. Moreover, as shown in FIG. 4, the housing 540 (namely, the first toner containing section 530*a*) has an aperture 572 at its lower part, and the developing roller 510 is arranged such that it protrudes into this aperture 572.

The toner supplying roller 550 includes a roller section made of a porous foamed material with elasticity, such as urethane foam, and a shaft serving as the rotation center of the roller section. The toner supply roller 550 is supported such that it can rotate around the shaft by being supported at both end sides of the shaft by the housing 540. The roller section is accommodated (within the housing 540) in the above-mentioned first toner containing section 530*a* of the housing 540, contains the toner T contained in the first toner containing section 530*a* in its pores and supplies the toner contained mainly in its pores to the developing roller 510. The toner supply roller 550 is arranged vertically below the first toner containing section 530*a*. The toner T contained in the first toner containing section 530*a* is supplied by the toner supply roller 550 to the developing roller 510 at the bottom portion of the first toner containing section 530*a*. Also, the toner supply roller 550 scrapes off, from the developing roller 510, the remaining toner T that has remained on the developing roller 510 after the development. At that time, the toner remaining on the developing roller 510 is scraped off by the wall regions surrounded by the plurality of pores formed on the toner supply roller 550 contacting the developing roller 510. That is to say, the toner remaining on the developing roller 510 is scraped off mainly by the wall regions of the toner supplying roller 550.

The toner supplying roller 550 and the developing roller 510 are mounted to the housing 540 in a state in which they are pressed against each other. Therefore, the roller section of the toner supply roller 550 contacts against the developing roller 510 in a state of elastic deformation. The shaft of the toner supply roller 550 is lower than the rotation center axis of the developing roller 510. The toner supply roller 550 rotates in a direction (the clockwise direction in FIG. 4) that is opposite the rotation direction of the developing roller 510 (the counterclockwise direction in FIG. 4). It should be noted that in this embodiment, a rotation speed difference between the toner supply roller 550 and the developing roller 510 is employed, and the speed with which the surface of the toner supply roller 550 moves when the toner supply roller 550 rotates is about 1.5 times the speed with which the surface of the developing roller 510 moves when the developing roller 510 rotates.

The upper seal 520, which contacts against the developing roller 510 along its axial direction, allows the movement of toner T that has remained on the developing roller 510 after passing the developing position into the housing 540, and restricts the movement of toner T inside the housing 540 to out of the housing 540. The upper seal 520 is a seal made of polyethylene film or the like. The upper seal 520 is supported by an upper seal support section 526*a* of the holder, and is provided such that its longitudinal direction extends in the axial direction of the developing roller 510. It should be noted that the contact position where the upper seal 520 contacts the developing roller 510 is above the center axis of the developing roller 510.

Moreover, an upper seal biasing member 524 made of an elastic member such as Moltopren is provided in a compressed state between the upper seal support section 526*a* and the surface of the upper seal 520 that is on the side facing away from the contact surface 520*b* contacting the developing roller 510 (this surface is also referred to as "opposite surface 520*c*"). This upper seal biasing member 524 presses the upper seal 520 against the developing roller 510 by biasing the upper seal 520 towards the developing roller 510 with its biasing force.

The regulating blade 560 contacts at a contacting section 562*a* against the developing roller 510 from a one end portion all the way to the other end portion in the axial direction of the developing roller 510, and regulates the thickness of the toner T borne by the developing roller 510. Moreover, it applies a charge to the toner T borne by the developing roller 510. As shown in FIG. 4, the regulating blade 560 includes a rubber section 562 and a rubber support section 564.

The rubber section 562 is made of silicone rubber or urethane rubber or the like, and contacts against the developing roller 510.

The rubber support section 564 is made of a thin plate 564*a* and a thin plate support section 564*b*, and supports the rubber section 562 at its one end portion 564*d* in its transverse direction (that is, at the end portion on the side of the thin plate 564*a*). The thin plate 564*a* is made of phosphor bronze or stainless steel or the like and has elasticity. The thin plate 564*a* supports the rubber section 562 and presses the rubber section 562 with its biasing force against the developing roller 510. The thin plate support section 564*b* is a metal plate that is arranged on the other end portion 564*e* in the transverse direction of the rubber support section 564, and this thin plate support section 564*b* is attached to the thin plate 564*a* in a state in which it is supported at the end that is opposite from the side of the thin plate 564*a* that supports the rubber section 562.

The end of the regulating blade 560 on the side opposite to the side of the thin plate support section 564*b*, that is, its tip section 560*a*, is not in contact with the developing roller 510, but a portion thereof removed from this tip section 560*a* by a predetermined distance (that is, the contacting section 562*a*) is in contact with the developing roller 510 over a certain width. That is to say, the regulating blade 560 does not contact against the developing roller 510 at the edge, but contacts against it at its mid-portion, and the layer thickness is regulated by the planar surface of the regulating blade 560 (more specifically, the planar surface of the rubber section 562) contacting against the developing roller 510. Also, the regulating blade 560 is disposed such that its tip section 560*a* is facing upstream with respect to the direction in which the developing roller 510 rotates, and is in so-called counter contact. It should be noted that the contact position where the regulating blade 560 contacts the developing roller 510 is below the center axis of the developing roller 510 and the center axis of the toner supply roller 550. Moreover, the regulating blade 560 has the function of preventing toner T from leaking from the toner container 530 by contacting against the developing roller 510 along its axial direction.

Operation Example of the Developing Device

In the yellow developing device 54 configured in this manner, the toner supplying roller 550 supplies the toner T contained in the toner container 530 to the developing roller 510. As the developing roller 510 rotates, the toner T that is supplied to the developing roller 510 is brought to the contact position of the regulating blade 560, and when it passes that contact position, the layer thickness of the toner T is regulated, and a charge is applied to it. The toner T on the charged developing roller 510, whose layer thickness has been regulated, is brought to the developing position in opposition to the photoconductor 20 by further rotation of the developing roller 510, and is supplied for the development of the latent image formed on the photoconductor 20 in an alternating electric field at the developing position. The toner T on the developing roller 510 that has passed the developing position due to further rotation of the developing roller 510 passes the upper seal 520 and is collected in the developing device without being scraped off by the upper seal 520. Moreover, the toner T that is still remaining on the developing roller 510 is scraped off by the toner supplying roller 550.

The Surface Shape of the Developing Roller 510

Figure 5:
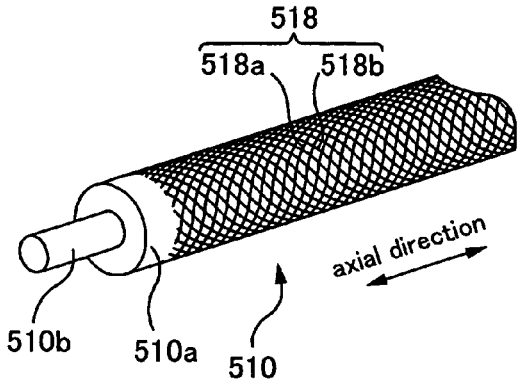
FIG. 5 is a schematic perspective view of a developing roller 510 and is a diagram showing helical first grooves 518*a* and second grooves 518*b*, whose winding directions differ.
Figure 6:
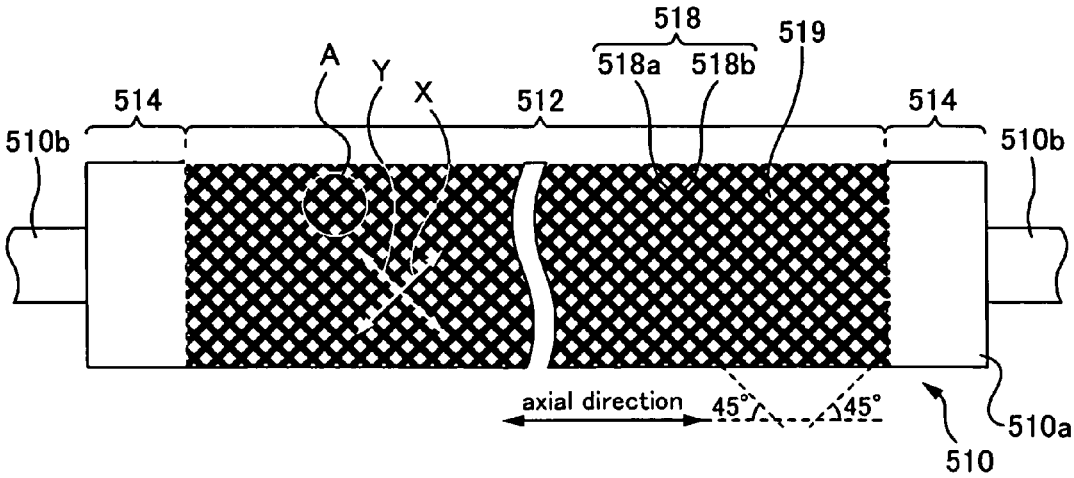
FIG. 6 is a schematic front view of the developing roller 510.
Figure 7:
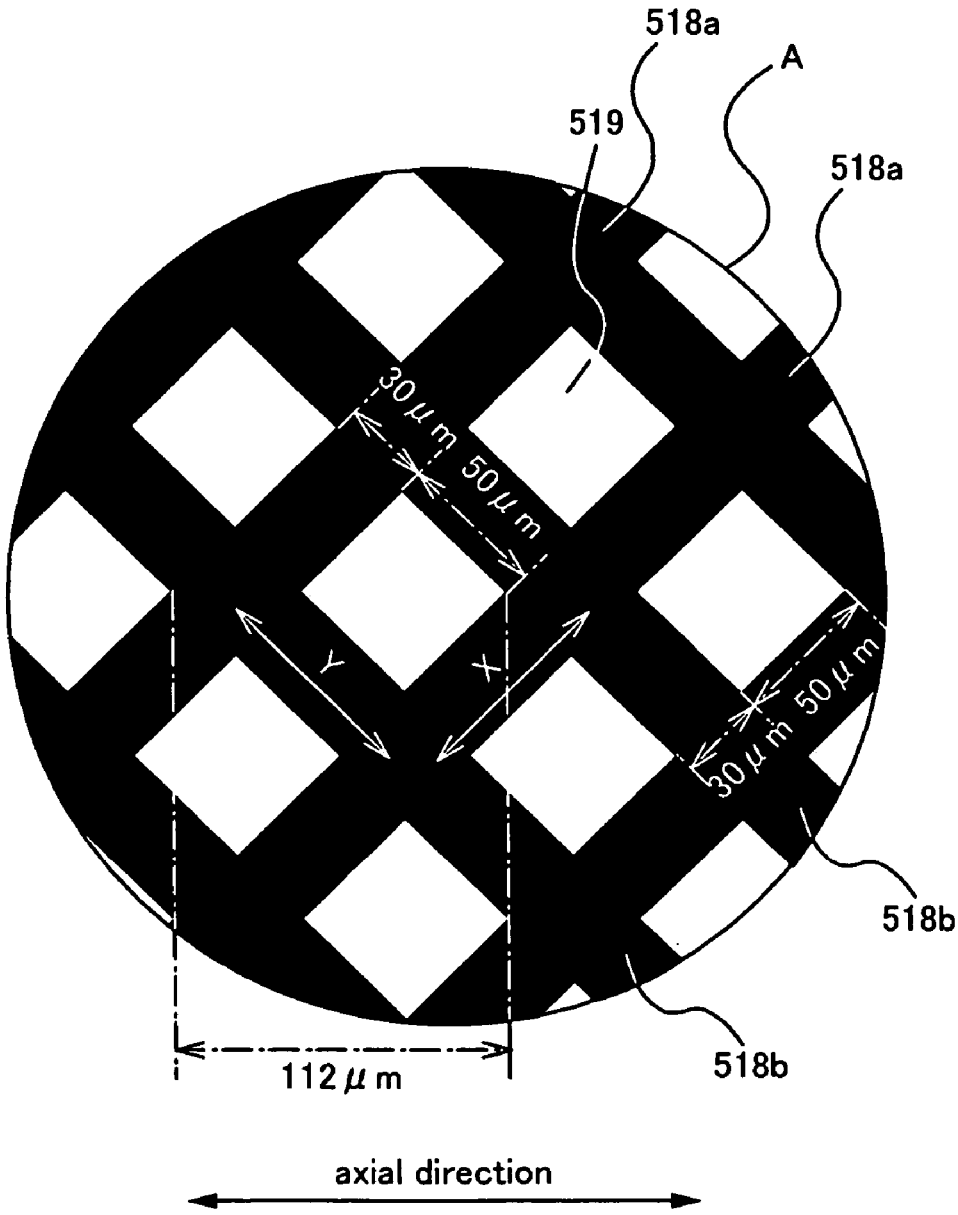
FIG. 7 is a schematic view showing the surface of the developing roller 510 and is an enlarged view of portion A shown in FIG. 6.
Figure 8:
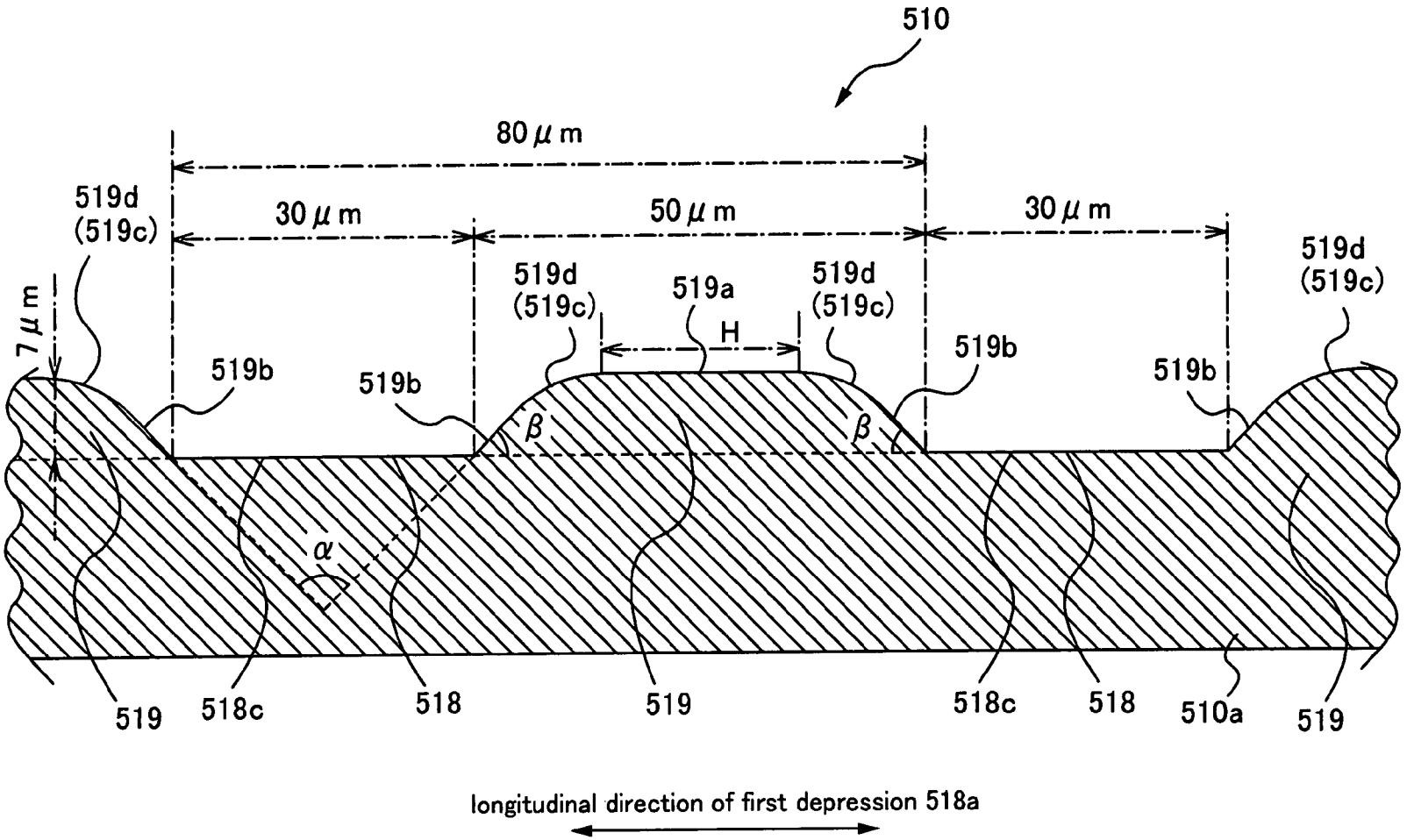
FIG. 8 is a schematic view showing the cross-sectional shape of projection portions 519 and depression portions 518.

Next, the surface shape of the developing roller 510 is explained with reference to FIGS. 5 to 8. FIG. 5 is a schematic perspective view of the developing roller 510, showing its depression portions 518. FIG. 6 is a schematic front view of the developing roller 510. FIG. 7 is a schematic view showing the surface of the developing roller 510, and is an enlarged view of the portion A shown in FIG. 6. FIG. 8 is a schematic view showing the cross-sectional shape of the projection portions 519 and the depression portions 518.

In FIGS. 5 to 7, the arrows indicate the axial direction of the developing roller 510, whereas in FIG. 8, the arrows indicate the longitudinal direction of the first depression portions 518*a*. For illustrative reasons, the scale of the projection portions 519 and the like in FIGS. 5 to 8 is different from the actual scale. Moreover, in FIG. 6 and FIG. 7, the direction of the arrow X indicates the longitudinal direction of the first depression portions 518*a* and the direction of the arrow Y indicates the longitudinal direction of the second depression portions 518*b*. FIG. 8 shows a cross section taken along the longitudinal direction of the first depression portions 518*a*, shown by the arrow Y in FIG. 6. It should be noted that also when taking the cross section of the projection portions 519 and depression portions 518 along the longitudinal direction of the second depression portions 518*b* shown by the arrow X in FIG. 6, the cross-sectional shape of the projection portions 519 and depression portions 518 is the same as the cross-sectional shape of the projection portions 519 and depression portions 518 shown in FIG. 8.

As shown in FIGS. 5 and 6, the developing roller 510 includes a cylindrical section 510*a* and axle sections 510*b*. The cylindrical section 510*a* bears the toner particles on its surface. This cylindrical section 510*a* is made of a single material, such as aluminum alloy, and its surface includes an indentation processed section 512 and non-indentation processed sections 514. The axle sections 510*b* are positioned on both axial ends of the developing roller 510 and are supported by the housing 540 via bearings (not shown in the drawings).

The indentation processed section 512 is the portion positioned in the center in the axial direction of the developing roller 510, and its surface has been provided with a profile in order to suitably bear the toner T (that is, the projection portions 519 and the depression portions 518 of the indentation processed section 512 both have the function to serve as a toner-bearing section for bearing the toner particles (toner T)). In this embodiment, a so-called rolling process (which is explained in detail in the section regarding the method for manufacturing the developing roller 510 explained below) is used for the indentation process, and the depression portions 518 and projection portions 519 are formed on the surface of the indentation processed section 512 by this rolling process. More specifically, grooves are formed by this rolling process in the surface of the indentation processed section 512, and thus the indentation processed section 512 is provided with the depression portions 518 and the projection portions 519.

As shown in FIG. 5, the depression portions 518 are oblique with respect to the axial direction and the circumferential direction of the developing roller 510, and constitute helical grooves that are formed at a constant pitch in the axial direction. Two types of the depression portions 518 (the first depression portions 518*a* and the second depression portions 518*b*), whose inclination angle with respect to the axial direction and the circumferential direction of the developing roller 510 differs, are formed.

That is to say, the first depression portions 518*a* are formed helically, such that they define an angle of 45° in the counter-clockwise direction with the axial direction of the developing roller 510, and the second depression portions 518*b* are formed helically, such that they define an angle of 45° in the clockwise direction with the axial direction of the developing roller 510. Therefore, the first depression portions 518*a* and the second depression portions 518*b* intersect at an angle of 90°. Furthermore, the first depression portions 518*a* and the second depression portions 518*b* are formed with the same pitch in the axial direction of the developing roller 510, and in this embodiment, this pitch is about 112 μm, as shown in FIG. 7.

As shown in FIG. 6, the projection portion 519 is provided surrounded by the two kinds of depression portions (that is, the first depression portion 518*a* and the second depression portion 518*b*). The projection portion 519 includes a top surface 519*a* and a lateral surface 519*b* connected to this top surface 519*a*.

As shown in FIG. 8, the top surface 519*a* includes a flat portion. As shown in FIG. 7, the top surface 519*a* has a substantially square shape. Moreover, the top surface 519*a* is formed such that one of the two diagonal lines of the square shape of the top surface 519*a* coincides with the axial direction of the developing roller 510 and the other diagonal line coincides with the circumferential direction of the developing roller 510 respectively. Moreover, the width H of the top surface 519*a* is equal to or more than the volume average particle diameter of the toner particles (7 μm), and in this embodiment it is about 30 μm.

As shown in FIG. 8, the lateral surface 519*b* is connected to a flat bottom surface 518*c* of the depression portion 518, and is a slanted surface that is slanted with respect to the bottom surface 518*c*. Moreover, the inclination angle of the lateral surface 519*b* from the bottom surface 518*c* of the depression portion 518 (in FIG. 8, this is the angle marked β) is equal to or less than 45°, and in this embodiment, this inclination angle is 45°.

As shown in FIG. 8, a connection section 519*c* connecting the top surface 519*a* with the lateral surface 519*b* is provided with a rounding 519*d*. The radius of curvature of this rounding 519*d* is equal to ore more than half the volume average particle diameter of the toner particles (7 μm), and in this embodiment it is 20 μm. It should be noted that in this embodiment, the cross-sectional shape of the rounding 519*d* is that of a circular arc connecting the top surface 519*a* with the lateral surface 519*b*, as shown in FIG. 8. At this time, the above-noted radius of curvature is the same size as the radius of this arc.

Moreover, the height of the projection portion 519 (the depth of the depression portion 518), that is, the distance between the top surface 519*a* of the projection portion 519 and the bottom surface 518*c* of the depression portion 518, is equal to or more than twice the volume average particle diameter of the toner particles (7 μm). It should be noted that in this embodiment, the depth of the depression portion 518 is about 7 μm, which is the same size as the volume average particle diameter of the toner particles. Moreover, the width of the depression portion 518 is about 30 μm, and the groove angle (the angle marked by symbol α in FIG. 8) is about 90°.

As shown in FIG. 6, the non-indentation processed sections 514 are the parts where the surface is not subject to such indentation process (i.e. the rolling process). The non-indentation processed sections 514 are positioned between the indentation processed section 512 and the axle sections 510*b* in the axial direction of the developing roller 510, and their surface is in a smooth condition (with a ten-point average roughness Rz of the surface 1 μm or less).

Method for Manufacturing the Developing Roller 510

Figure 9:
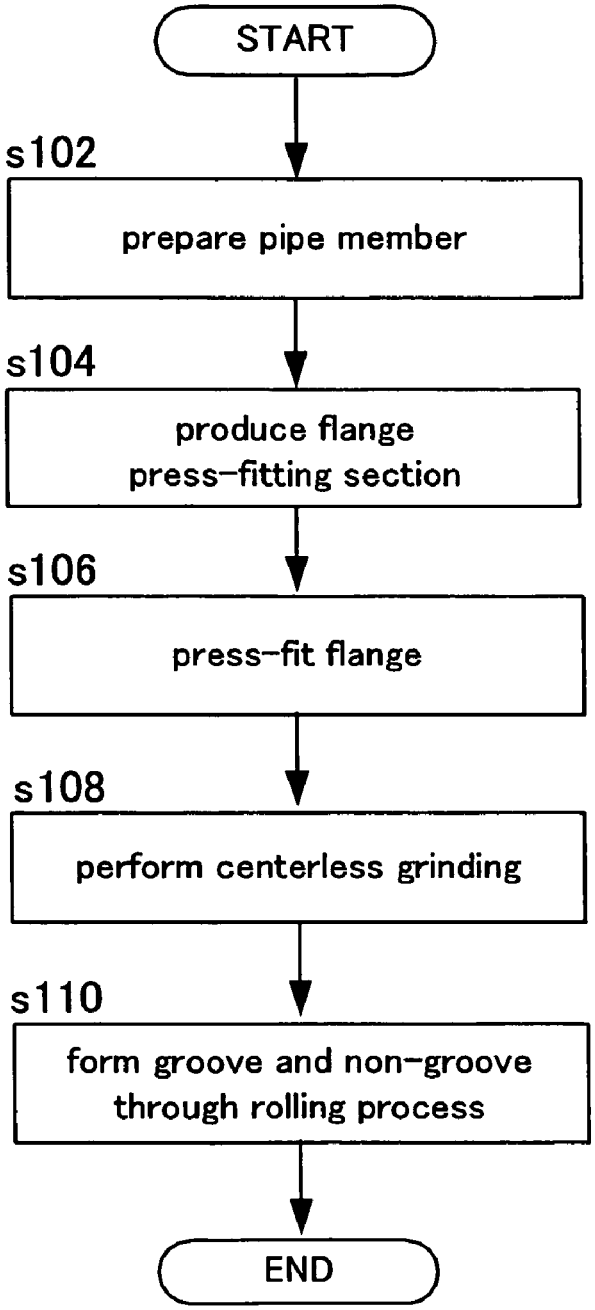
FIG. 9 is a flowchart illustrating a method for manufacturing the developing roller 510.
Figure 10A:
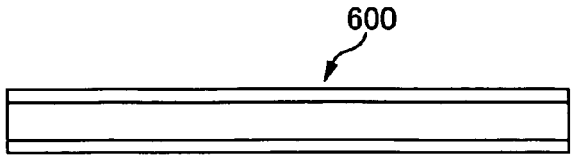
FIG. 10A to 10E are schematic views of the transformation of the developing roller 510 during the manufacturing process of the developing roller 510.
Figure 10B:
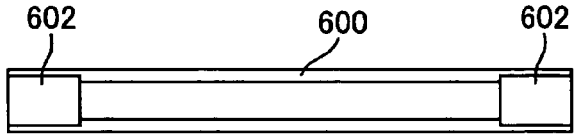
Figure 10C:
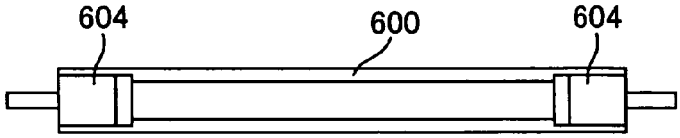
Figure 10D:
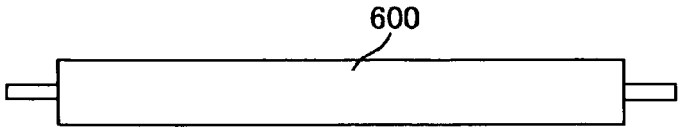
Figure 10E:
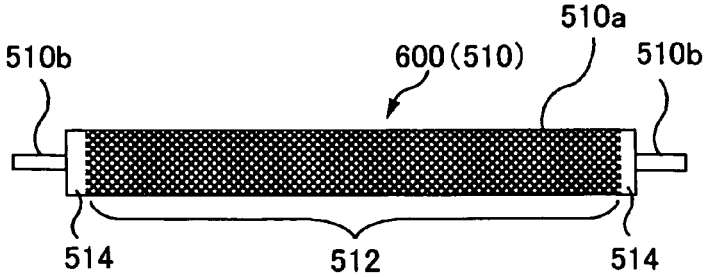
Figure 11:
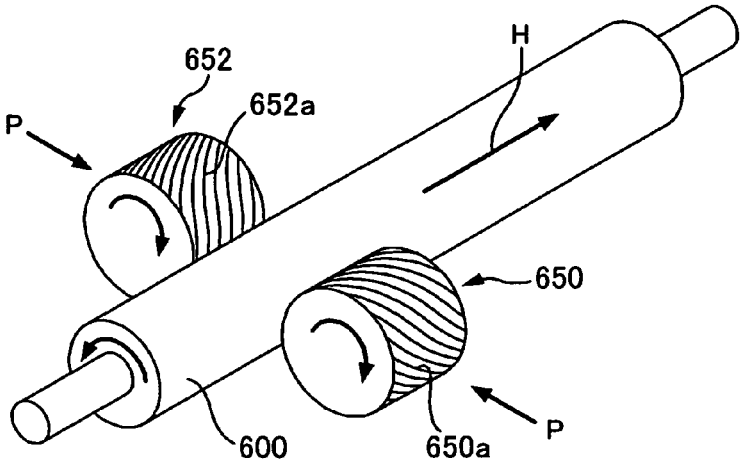
FIG. 11 is an explanatory diagram illustrating the rolling process of the developing roller 510.

Following is an explanation of a method for manufacturing the developing roller 510 having the above-described surface shape (depression portions 518 and projection portions 519), with reference to FIG. 9, FIGS. 10A to 10E, and FIG. 11. FIG. 9 is a flowchart illustrating the method for manufacturing the developing roller 510. FIGS. 10A to 10E are schematic views showing the transformation of the developing roller 510 during the manufacturing process of the developing roller 510. FIG. 11 is an explanatory diagram explaining the rolling process of the developing roller 510. It should be noted that FIGS. 10A to 10C each show a cross section of a pipe member 600, whereas FIGS. 10D and 10E show the outer circumference of the pipe member 600.

First, as shown in FIG. 10A, a pipe member 600 is provided as the base material of the cylindrical section 510*a* of the developing roller 510 (Step s102). The wall thickness of this pipe member 600 is 0.5 to 3 mm.

Next, as shown in FIG. 10B, flange press-fitting sections 602 are formed on both ends in the longitudinal direction of the pipe member 600 (Step s104). The flange press-fitting sections 602 are made by a cutting process.

Next, as shown in FIG. 10C, flanges 604 that are parts of the axle sections 510*b* of the developing roller 510 are press-fitted to the flange press-fitting sections 602 (Step s106). In order to reliably fasten the flanges 604 to the pipe member 600, it is also possible to glue or weld the flanges 604 to the pipe member 600 after press-fitting the flanges 604.

Next, as shown in FIG. 10D, the surface of the pipe member 600 to which the flanges 604 have been press-fitted is subjected to centerless grinding (Step s108). This centerless grinding is performed on the entire surface, and the ten-point average roughness Rz of the surface after the centerless grinding is 1.0 μm or less.

Next, as shown in FIG. 10E, the portion corresponding to the indentation processed section 512 of the pipe member 600 to which the flanges 604 have been press-fitted is provided with the depression portions 518 and the projection portions 519 by a rolling process (Step s110). In this embodiment, a so-called through-feed rolling process (also referred to as "continuous rolling") using two round dies 650, 652 is performed.

That is to say, as shown in FIG. 11, two round dies 650, 652 arranged such that they sandwich the pipe member 600 serving as the workpiece are rotated in the same direction (see FIG. 11) while being pressed with a predetermined pressure (the direction of this pressure is marked with symbol P in FIG. 11) against the pipe member 600. The surface of the round dies 650, 652 is provided with projection portions 650*a*, 652*a* for forming the depression portions 518, and the depression portions 518 and the projection portions 519 are formed in the pipe member 600 by deforming the pipe member 600 with the projection portions 650*a*, 652*a*. It should be noted that in the through-feed rolling process, by rotating the round dies 650, 652, the pipe member 600 is moved in the direction marked by symbol H in FIG. 11 while rotating in the direction opposite to the rotation direction of the round dies 650, 652 (see FIG. 11). Then, in the portion corresponding to the indentation processed section 512, the first depression portions 518*a* are formed by the projection portions 650*a* of the round die 650, and the second depression portions 518*b* are formed by the projection portions 652*a* of the round die 652. Also as mentioned above, the connection sections 519*c* of the projection portions 519 of the developing roller 510 are provided with roundings 519*d* (see FIG. 8), and the projection portions 650*a* and 652*a* of the round dies are provided with a shape for forming these roundings 519*d*.

In above method for manufacturing the developing roller 510, the surface of the developing roller 510 is provided through this rolling process (Step s110) with the top surface 519*a* having a flat portion, and the projection portion 519 is formed such that the width of the top surface 519*a* is equal to or more than the volume average particle diameter of the toner particles.

Advantageous Effects of the Developing Device According to the Present Embodiment As described above, the toner particle-bearing rollers (developing rollers 510) of the developing devices 51, 52, 53 and 54 according to this embodiment have projection portions 519 that are provided with the top surface 519*a* having a flat portion, as shown in FIG. 8, and such projection portion 519 has a width H of the top surface 519*a* that is equal to or more than the volume average particle diameter of the toner particles. Thus, it is possible to suppress a deformation of the toner particles. It is described in greater detail in the following.

If the surface of the developing roller 510 is provided with projection portions, then forces may act locally from the projection portions on the toner particles, depending on the shape of the projection portions. For example, if the projection portions are sharp, the force from the projection portion may concentrate locally on the toner particle when the projection portions contact the toner particles. Thus, when the forces from the projection portions concentrate locally on the toner particles, the forces may cause a deformation of the toner particles and there is the risk that the toner particles may break.

On the other hand, like in this embodiment, if the projection portion 519 having the top surface 519*a* having a flat portion is provided and the projection portion 519 is provided such that the width of the top surface 519*a* is equal to or more than the volume average particle diameter of the toner particles, the forces acting from the projection portions 519 (the top surfaces 519*a*) on the toner particles when the top surfaces 519*a* contacts the toner particles are dispersed. Therefore, with the developing roller 510 according to this embodiment, it is possible to avoid the forces from the projection portions 519 concentrating locally on the toner particles, so that it becomes possible to suppress the deformation of the toner particles by such forces.

The Relation Between the Depression Portions 518 and the Latent Image

Laser beam printers form a latent image on the photoconductor 20 with a laser beam, as explained above, and make the resulting latent image visible as a toner image with the toner borne by the developing roller 510. At this time, by turning the laser beam scanned in the main scanning direction on and off, dot-shaped latent images are formed on the photoconductor 20 in a region partitioned in a grid-like manner, the so-called "screen". The latent image is constituted by these dot-shaped latent images.

On the other hand, in the case of the developing roller 510 having clearly distinguished depression portions 518 and projection portions 519, as in this embodiment, for example, there is the risk that more toner particle T may go into the depression portions 518 than the projection portions 519. In this case, there is the risk that the density of the toner image at positions developed by the depression portions 518 differs from the density at the positions developed by the projection portions 519. More specifically, the influence on the image not having a large surface area, such as text or line image, is small, however density variation may become easily discernible in the case of the image having a large surface area, such as photos or illustrations. This phenomenon becomes even more conspicuous when the pitch in the axial direction of the depression portions 518 formed in the developing roller 510 is larger than the pitch of the grid in the main scanning direction of the above-mentioned screen (the direction corresponding to the axial direction of the developing roller 510). This is because the density of dots that should actually be formed with the same density differs depending on whether they are developed with the depression portions 518 or the projection portions 519 in the developing roller 510.

Therefore, in the developing roller 510 of this embodiment, the pitch of the depression portion 518 with respect to the axial direction is set to be smaller than the maximum pitch of the grid when forming an image having a certain surface area, such as a photo or an illustration. Here, the pitch of the grid in the main scanning direction of the latent image (the direction corresponding to the axial direction of the developing roller 510) when forming an image having a large surface area, such as the photo or the illustration is not the pitch between the dots in the image of the highest resolution that can be formed by the laser beam printer (that is, the grid can be formed by a plurality of different pitches in the main scanning direction (axial direction)). This is because when forming an image having a large surface area, such as the photo or the illustration with the laser beam printer, the printer forms dots with a resolution that is lower than the highest resolution of the printer, and the overall image quality is improved by providing the dots with gradation properties.

Figure 12:
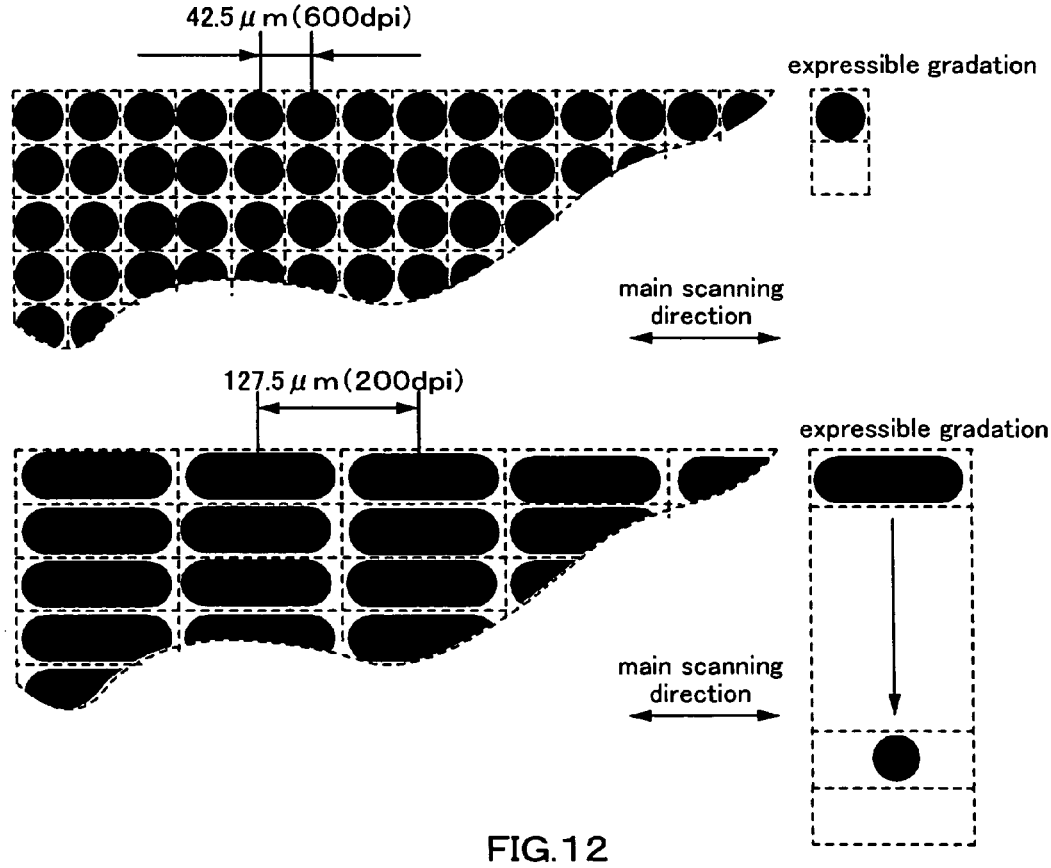
FIG. 12 is a diagram illustrating the pitch in a latent image and a screen.

FIG. 12 is a diagram for illustrating a screen and the pitch in a latent image. As shown in this image, if the highest resolution of the printer is for example 600 dpi (corresponding to a pitch of 42.5 μm), and the resolution of the latent image is set to 600 dpi, the region where dot-shaped latent images can be formed are partitioned into a grid with a pitch of 42.5 μm. Therefore, in each of the partitioned regions, the gradation can be expressed only through presence or absence of a dot-shaped latent image (see upper half of FIG. 12).

To address this issue, when forming an image having a large surface area, gradations can be expressed by turning three dot-shaped latent images at a resolution of 600 dpi into one dot-shaped latent image, and changing the length of time for which the laser beam is emitted within the time in which the semiconductor laser can respond to three dot-shaped latent images at a resolution of 600 dpi (see lower half in FIG. 12). In this case, the resolution when forming an image having a large surface area becomes 200 dpi, and the region at which dot-shaped latent images can be formed is partitioned to a grid-shape with a pitch of 127.5 μm. Therefore, with the developing roller 510 of this embodiment, by setting the pitch of the depression portion 518 in the axial direction to about 112 μm, as shown in FIG. 8, each of the dot-shaped latent images formed in the region partitioned into a grid of 200 dpi, that is, 127.5 μm pitch are developed at positions that each include the depression portion 518 and the projection portion 519 of the developing roller 510, so that density variations in the developed toner image can be suppressed.

In this embodiment, an example has been explained in which the maximum resolution of the laser beam printer is 600 dpi, and the pitch in the axial direction of the region partitioned into grid-shape, in which dot-shaped latent images can be formed when forming an image such as a photo, is 127.5 μm, and the pitch in the axial direction of the depression portions 518 of the developing roller 510 is 112 μm, but there is no limitation to this, as long as the pitch in the axial direction of the depression portions 518 of the developing roller 510 is smaller than the pitch in the axial direction of the region partitioned into grid-shape in which dot-shaped latent images are formed by a latent image when forming an image such as a photo.

Other Embodiments

Second to Fourth Embodiments

A developing device or the like according to the present invention was explained by way of the foregoing embodiment, but the foregoing embodiment of the invention is merely for the purpose of elucidating the present invention and is not to be interpreted as limiting the present invention. The invention can of course be altered and improved without departing from the gist thereof and equivalents are intended to be embraced therein.

In the foregoing embodiment, an intermediate image transfer type full-color laser beam printer was described as an example of the image forming apparatus, however the present invention can also be applied to various other types of image forming apparatuses, such as full-color laser beam printers that are not of the intermediate image transfer type, monochrome laser beam printers, copying machines, and facsimiles.

Moreover, also the photoconductor is not limited to a so-called photoconductive roller, which is configured by providing a photoconductive layer on the outer circumferential surface of a hollow cylindrical conductive base, and can also be a so-called photoconductive belt, which is configured by providing a photoconductive layer on the surface of a belt-shaped conductive base.

Moreover, in the foregoing embodiment, it was explained that the volume average particle diameter of the toner particles is 7 μm, but there is no limitation to this, and the volume average particle diameter of the toner particles may be any size from 5 to 10 μm.

Furthermore, in the foregoing embodiments, as shown in FIG. 4, the developing devices 51, 52, 53, and 54 contact against the developing roller 510 all the way from one end portion to the other end portion in the axial direction of the developing roller 510, and a layer thickness regulating member (regulating blade 560) is provided for regulating the layer thickness of the toner particles borne by the developing roller 510. The regulating blade 560 then regulates the layer thickness by letting a planar surface of the regulating blade 560 contact against the developing roller 510. However, there is no limitation to this. For example, it is also possible that the regulating blade 560 regulates the layer thickness by contacting with its edge against the developing roller 510.

If the layer thickness is regulated by letting the edge of the regulating blade 560 contact against the developing roller 510, the toner borne by the projection portion 519 is scraped off by the regulating blade 560. On the other hand, if the layer thickness is regulated by letting a planar surface of the regulating blade 560 contact against the developing roller 510, as in this embodiment, then the toner particles are pressed by the regulating blade 560 toward the projection portions 519 (the top surfaces 519*a*), so that the toner particles do not tend to be scraped off by the regulating blade 560. Then, when the regulating blade 560 presses against the toner particles, a force from the projection portions 519 is easily exerted on the toner particles borne by the projection portion 519. For this reason, in the above case, the effect of providing the surface of the developing roller 510 with the projection portions 519 having the top surfaces 519*a*, that is, the effect of suppressing deformations and the like of the toner particles, can be displayed more advantageously. Consequently, the above-described embodiment is more preferable.

Furthermore, in the above-described embodiment, the projection portions 519 are provided with lateral surfaces 519*b* connected to the top surfaces 519*a*, as shown in FIG. 8. Also, the connection section 519*c* connecting the top surfaces 519*a* with the lateral surfaces 519*b* are provided with a rounding 519*d*. However, there is no limitation to this. For example, as shown in FIG. 13, it is also possible to form the connection sections 519*c* with an angle, without providing the connection sections 519*c* with the rounding 519*d*.

If the connection section 519*c* is angular, forces from the angle formed by the edge tend to concentrate locally on the toner particles when the toner particles come into contact with this angle. On the other hand, if the connection section 519*c* is provided with the rounding 519*d*, no edge is formed in the connection section 519*c*, and therefore the forces applied from the connection section 519*c* on the toner particles can be reduced. Therefore, the above-described embodiment is more preferable with regard to reducing deformations of the toner particles.

Figure 13:
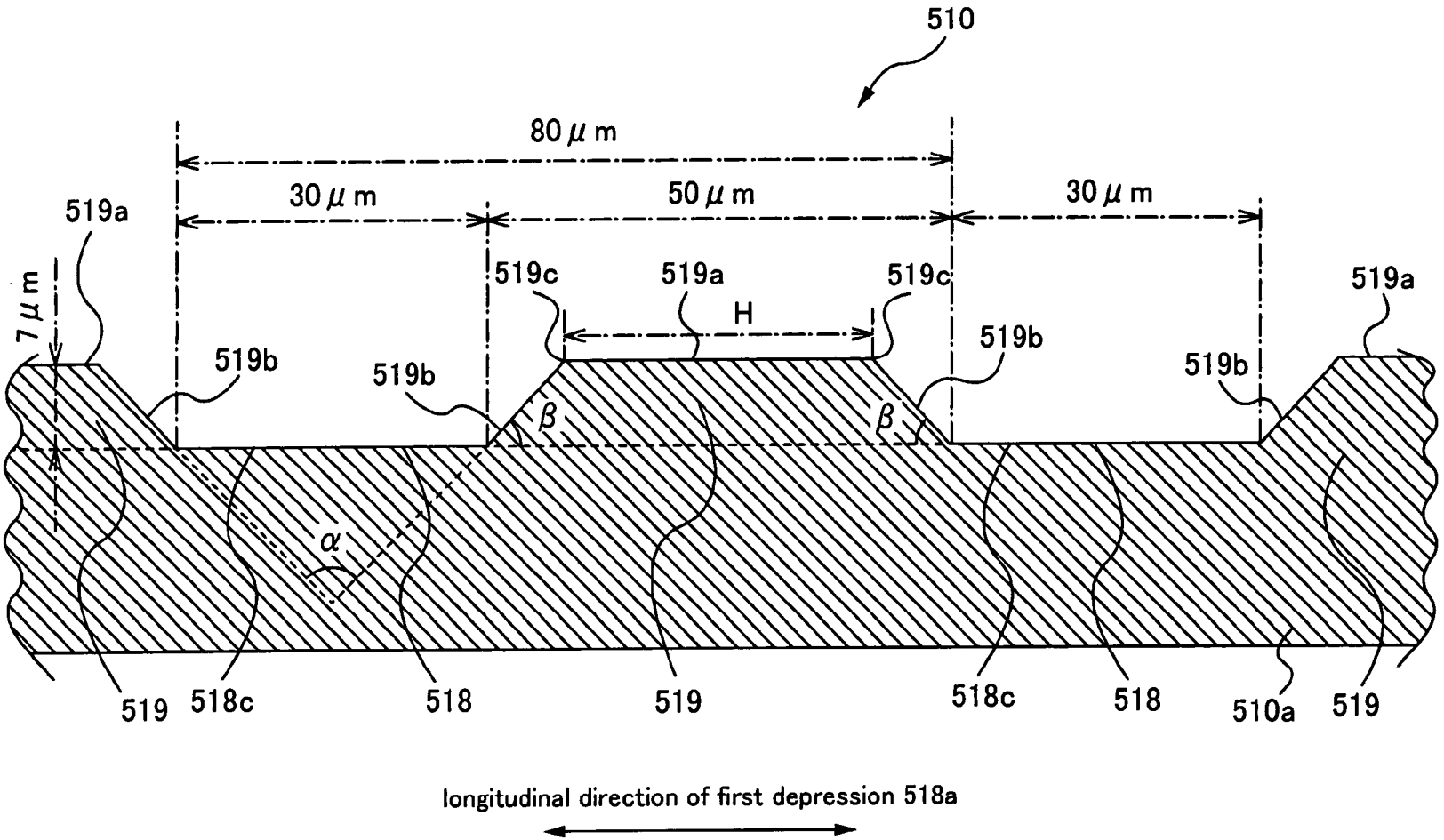
FIG. 13 is a diagram showing a modified example of the developing roller 510 and is a schematic view showing the cross-sectional shape of the projection portions 519.

The following is an explanation of the surface configuration of the developing roller 510 according to the modified example shown in FIG. 13. FIG. 13 is a diagram showing a modified example of the developing roller 510 and is a schematic view showing the cross-sectional shape of the projection portion 519. The developing roller 510 shown in FIG. 13 has a similar surface configuration (that is, provided with the projection portions 519 and the depression portions 518) as the developing roller 510 shown in FIG. 8, except that its connection portion 519*c* is not angular. Therefore, also the developing roller 510 according to this modified example has the top surface 519*a*, as shown in FIG. 13. Moreover, the width H of the top surface 519*a* is equal to or more than the volume average particle diameter of the toner particles (more specifically, the width H is about 36 μm).

Furthermore, in the above-described embodiment, the radius of curvature of the rounding 519*d* was set equal to or more than half the volume average particle diameter of the toner particles, as shown in FIG. 8, but there is no limitation to this. For example, the radius of curvature of the rounding 519*d* may also be smaller than half the volume average particle diameter of the toner particles.

If the radius of curvature of the rounding is less than half the volume average particle diameter of the toner particles, then forces from the roundings concentrate locally on the toner particles as the roundings cut into the toner particles when the toner particles come into contact with the roundings. On the other hand, if the radius of curvature of the roundings 519*d* is equal to or more than half the volume average particle diameter of the toner particles as in the above-described embodiment, then there is no risk that the rounding 519*d* cut into the toner particles, and the forces from the roundings 519*d* act on the toner particles in a dispersed manner. Therefore, the above-described embodiment is preferable with regard to reducing deformation and the like of the toner particles.

Furthermore, in the above-described embodiment, the depth of the depression portions 518 was set equal to or less than twice the volume average particle diameter of the toner particles, as shown in FIG. 8, but there is no limitation to this. For example, it is also possible to set the depth of the depression portion 518 to more than twice the volume average particle diameter of the toner particles.

If the depth of the depression portions 518 is set equal to or less than twice the volume average particle diameter of the toner particles, most of the toner particles positioned between the developing roller 510 and the regulating blade 560 in the depression portion 518 contact at least one of the developing roller 510 and the regulating blade 560, and therefore, the charge properties of the toner particles become suitable. For this reason, the above-described embodiment is more preferable. It should be noted that if the depth of the depression portions 518 is set equal to or less than (once) the volume average particle diameter of the toner particles, most of the toner particles positioned between the developing roller 510 and the regulating blade 560 in the depression portions 518 contact both the developing roller 510 and the regulating blade 560, which is even more preferable.

In addition, the following second to fourth embodiments are examples of further preferable embodiments (hereafter, the above-described embodiment is referred to as the "first embodiment" as a matter of convenience).

Second Embodiment

Figure 14:
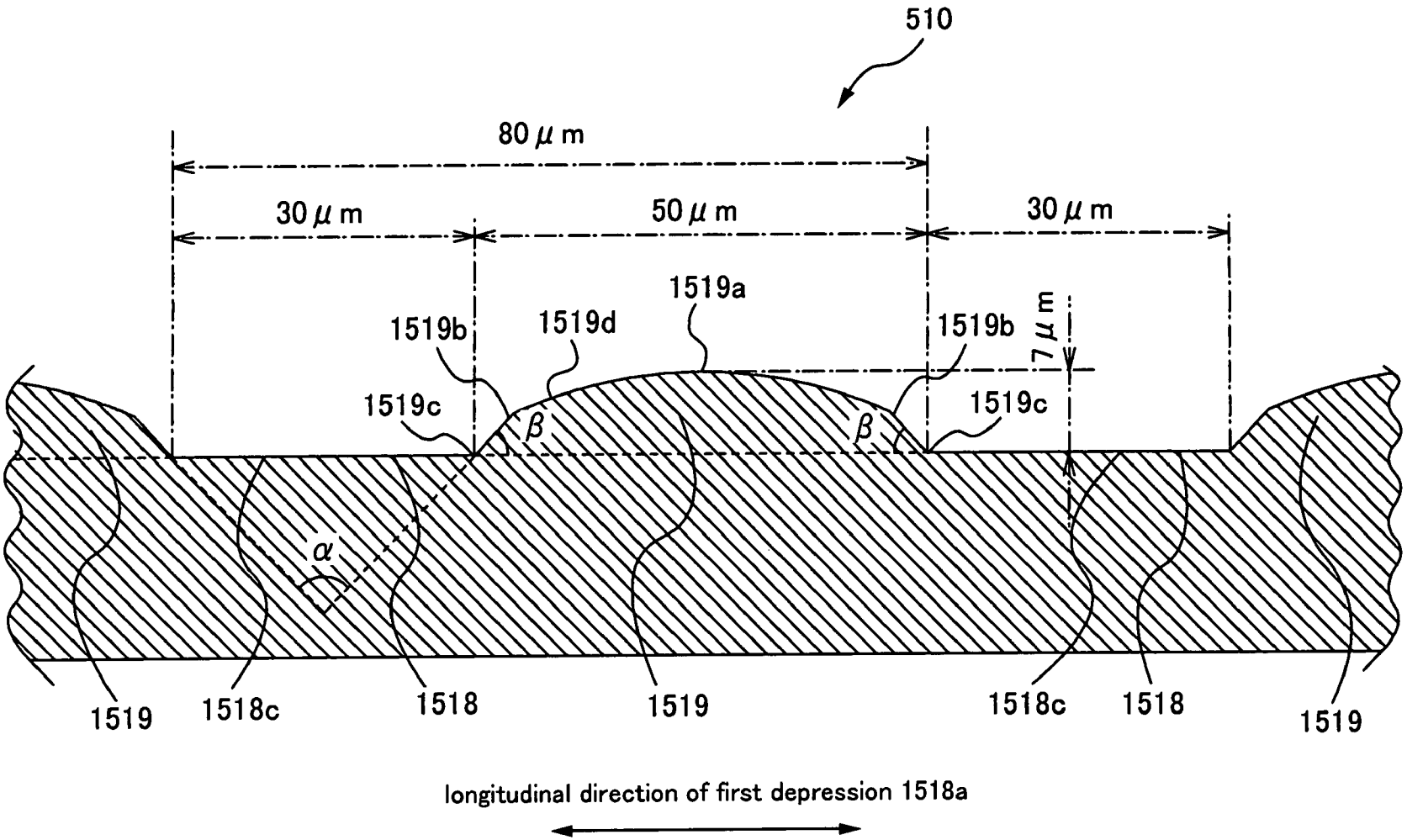
FIG. 14 is a schematic view showing the cross-sectional shape of the projection portion 1519 and the depression portion 1518 according to a second embodiment.

Configuration Example of Developing Roller 510 of Developing Device According to Second Embodiment Referring to FIG. 14, the following is an explanation of a configuration example of the developing roller 510 of the developing device according to a second embodiment. FIG. 14 is a diagram corresponding to FIG. 8 and is a schematic view showing the cross-sectional shape of the projection portions and depression portions according to the second embodiment.

As it becomes clear by comparing FIG. 8 and FIG. 14, the difference between the developing roller 510 of the developing device according to the second embodiment and the developing roller 510 of the developing device according to the first embodiment lies in the projection portion.

As shown in FIG. 14, the tip sections 1519*a* of the projection portion 1519 according to the second embodiment is provided with a rounding 1519*d*. Moreover, the radius of curvature of the rounding 1519*d* is set equal to or more than half the volume average particle diameter of the toner particles (7 μm).

Moreover, the projection portions 1519 are provided with lateral surfaces 1519*b* that are connected to the tip sections 1519*a*. The lateral surfaces 1519*b* are flat and extend from the lower section 1519*c* of the projection portions 1519 to the tip sections 1519*a*. As shown in FIG. 14, the lateral surfaces 1519*b* are connected to the flat bottom surface 1518*c* of the depression portions 1518, and are slanted surfaces that are slanted with respect to the bottom surfaces 1518*c*. Moreover, the inclination angle of the lateral surfaces 1519*b* from the bottom surfaces 1518*c* of the depression portions 1518 (in FIG. 14, it is the angle marked by symbol β) is 45° or less, and in this embodiment, this inclination angle is 45°. It should be noted that in this embodiment, the cross-sectional shape of the rounding 1519*d* is that of a circular arc connecting the two lateral surfaces 1519*b*, as shown in FIG. 14. At this time, the size of the above-noted radius of curvature is the same as the radius of this arc. Moreover, the height of the projection portions 1519 (the depth of the depression portions 1518) is equal to or less than twice the volume average particle diameter of the toner particles (7 μm).

Moreover, the developing roller 1510 whose surface is provided with the projection portions 1519 wherein at least the tip sections 1519*a* are provided with the rounding 1519*d*, and the radius of curvature of the rounding 1519*d* is equal to or more than half the volume average particle diameter of the toner particles can be manufactured by the above-described manufacturing method (rolling process).

Advantages of the Developing Device According to the Second Embodiment

As described above, the toner particle-bearing roller (the developing roller 510) of the developing device according to the second embodiment has the projection portion 1519 wherein at least the tip section 1519*a* is provided with the rounding 1519*d*, as shown in FIG. 14, and the radius of curvature of the rounding 1519*d* is equal to or more than half the volume average particle diameter of the toner particles. Thus, it is possible to suppress deformation of the toner particles. This is described in greater detail in the following.

If the surface of the developing roller 510 is provided with the projection portions, then forces may act locally from the projection portions on the toner particles, depending on the shape of the projection portions. For example, if the tip sections of the projection portions are sharp, then the forces from the tip sections may concentrate locally on the toner particles when the tip sections contact the toner particles. Thus, when the forces from the projection portions concentrate locally on the toner particles, the forces may cause a deformation of the toner particles and there is the risk that the toner particles may break.

If, on the other hand, as in this embodiment, the projection portions 1519 are provided wherein at least the tip sections

1519*a* are provided with roundings 1519*d* and the radius of curvature of the roundings 1519*d* equal to or more than half the volume average particle diameter of the toner particles, then the forces from the projection portions 1519 (the roundings 1519*d*) act on the toner particles in a dispersed manner when the roundings 1519*d* contacts the toner particles. Therefore, with the developing roller 510 according to this embodiment, it is possible to suppress the forces from the projection portions 1519 to concentrate locally on the toner particles, so that it is possible to suppress the deformation of the toner particles by such forces.

Third Embodiment

Figure 15:
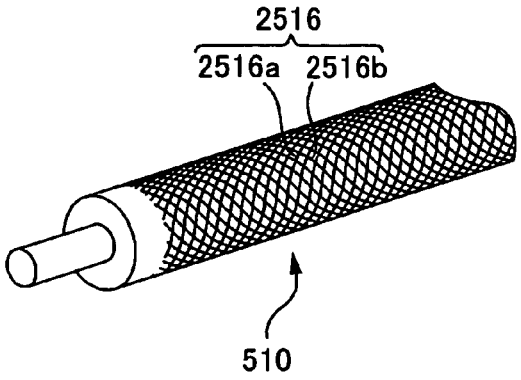
FIG. 15 is a schematic perspective view of the developing roller 510 according to a third embodiment.
Figure 16:
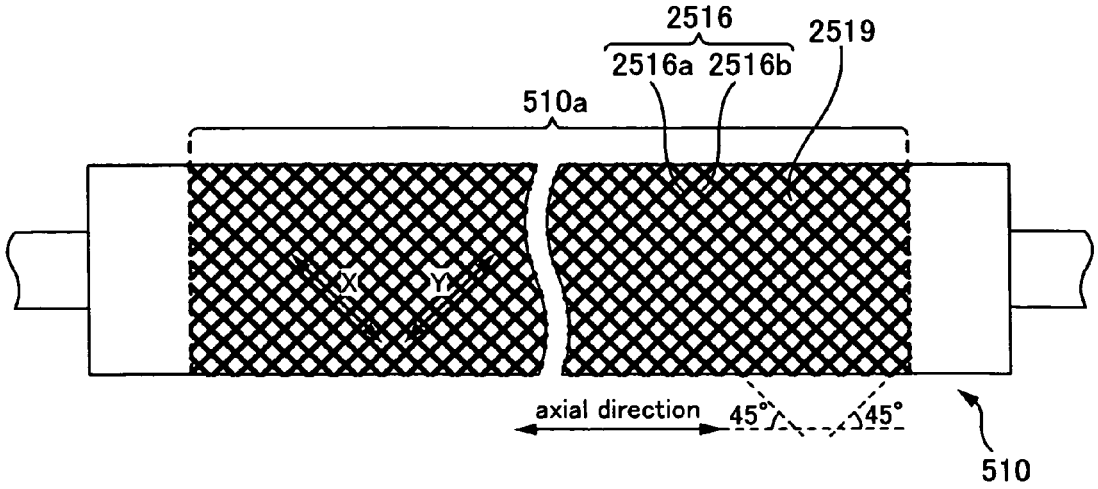
FIG. 16 is a schematic front view of the developing roller 510 according to the third embodiment.
Figure 17:
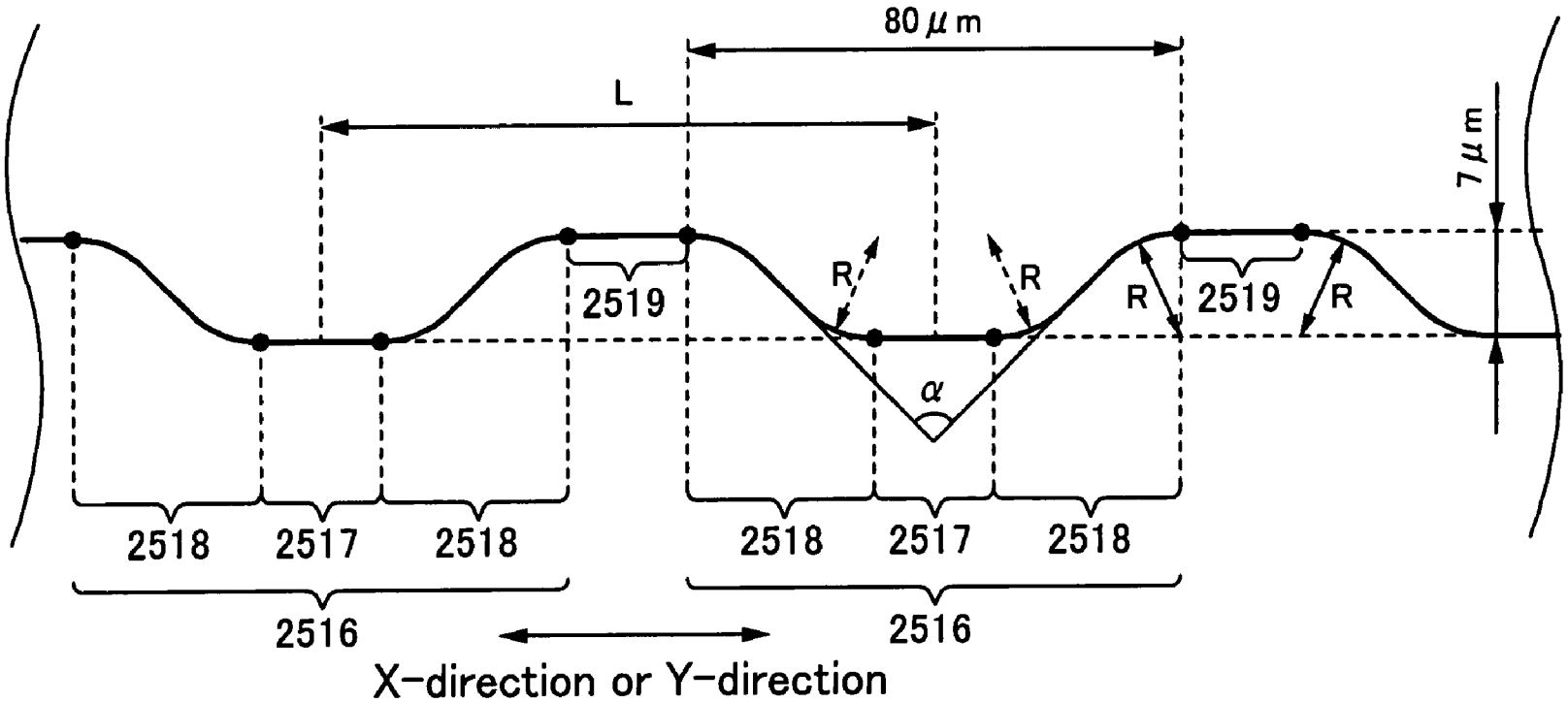
FIG. 17 is a schematic view showing the cross-sectional shape of the depression portion 2516 provided in the surface of the developing roller 510 according to the third embodiment.

Configuration Example of Developing Roller 510 of Developing Device According to Third Embodiment Referring to FIGS. 15 to 17, the following is an explanation of a configuration example of the developing roller 510 of the developing device according to a third embodiment. FIG. 15 is a schematic perspective view of the developing roller 510. FIG. 16 is a schematic front view of the developing roller 510. FIG. 17 is a schematic view showing the cross-sectional shape of the depression portions 2516 provided in the surface of the developing roller 510, showing a cross section taken along the direction marked by symbols X or Y in FIG. 16. It should be noted that for illustrative reasons, the scale of the depression portions 2516 and the like in FIGS. 15 to 17 is different than the actual scale.

The developing roller 510 of the developing device according to the third embodiment is a member made of an aluminum alloy, an iron alloy or the like, and transports the toner T borne on its surface to the developing position opposite the photoconductor 20.

In order to enable the developing roller 510 to suitably bear the toner, a center region 2510*a* of its surface is provided with depression portions 2516 and non-depression portions 2519, as shown in FIGS. 16 and 17 (it should be noted that the depression portions 2516 and the non-depression portions 2519 both serve as toner-bearing sections for bearing toner). In this embodiment, the depression portions 516 and the non-depression portions 519 which are formed by the above-described rolling process in the center 510*a* of the surface of the developing roller 510 are explained.

The depression portions 2516 are indented regions at the center region 510*a* of the surface of the developing roller 510, and includes a flat bottom surface 2517 as well as lateral surfaces 2518 adjacent to the bottom surface.

In this embodiment, as shown in FIG. 17, the aperture width and the depth of the depression portions 2516 are about 80 μm and about 7 μm, respectively. Moreover, the groove angle of the depression portions 2516 (the angle marked by symbol α in FIG. 17) is about 90°. Furthermore, the boundaries of the bottom surfaces 2517 and the lateral surfaces 2518 are provided with roundings whose radius of curvature R is equal to or more than half the volume average particle diameter (7 μm in this embodiment) of the toner T (in this embodiment, the toner T is of particulate shape).

The non-depression portions 2519 are flat surfaces at the highest positions in the center region 510*a* of the surface of the developing roller 510. As shown in FIG. 17, the non-depression portions 2519 are adjacent to the lateral surfaces 2518 at positions that are opposite to the bottom surfaces 2517 (that is, on the aperture side of the depression portions 2516). Furthermore, the roundings whose radius of curvature R is equal to or more than half the volume average particle diameter of the toner T are also provided at the boundaries between the non-depression portions 2519 and the lateral surfaces 2518.

In this embodiment, as shown in FIGS. 15 and 16, the depression portions 2516 formed in the center region 510*a* of the surface of the developing roller 510 by the rolling process are formed as two helical grooves of different winding directions (in the following, one of these helical grooves is referred to as "first groove 2516*a*" and the other is referred to as "second groove 2516*b*"). That is to say, in FIG. 16, the depression portions 2516 lined up in the cross section in X direction belong to the first grooves 2516*a*, and the depression portions 2516 lined up in the cross section in the Y direction belong to the second grooves 2516*b*. Here, the angles that the longitudinal directions of the first grooves 2516*a* and the second grooves 2516*b* respectively define with the axial direction of the developing roller 510 are each about 45°, as shown in FIG. 16. Moreover, the helical pitches of the first grooves 2516*a* and the second grooves 2516*b* (that is, the length marked by symbol L in FIG. 17) are both equidistant.

It should be noted that in the above-described embodiment, two helical grooves are formed in different winding directions in the center 510*a* of the surface of the developing roller 510 as the depression portions 2516, but there is no limitation to this. For example, it is also possible that only the first grooves 2516*a* or only the second grooves 2516*b* are provided.

Furthermore, for the round dies 650, 652 used when the through-feed rolling process is performed, in order to realize the developing roller 510 according to this embodiment, the dies with a rounding whose radius of curvature is larger than half the volume average particle diameter of the toner at the edge portion of their projection portions 650*a*, 652*a* (for example, rounded dies) may be used.

Advantages of Developing Device According to the Third Embodiment

As explained above, the developing roller 510 according to this embodiment has in its surface depression portions 2516 provided with flat bottom surfaces 2517 and lateral surfaces 2518 adjacent to the bottom surfaces, wherein the boundaries between the bottom surfaces and the lateral surfaces are provided with roundings whose radius of curvature R is equal to or more than half the volume average particle diameter of the toner. Thus, it is possible to realize a developing roller with which the accumulation of the toner can be suitably suppressed.

That is to say, as explained above, the surface of the developing roller 510 is provided with the depression portions 2516, having the flat bottom surfaces 2517 and the lateral surfaces 2518 adjacent to these bottom surfaces, in order to suitably bear the toner.

Figure 18:
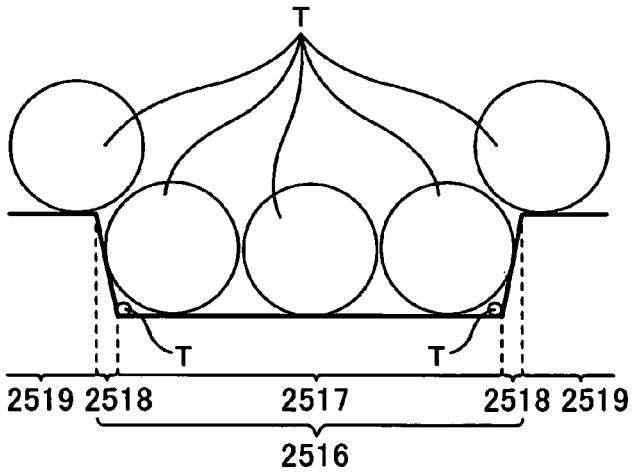
FIG. 18 is an explanatory diagram illustrating the problem that occurs in a depression portion 2516 of a developing roller 510 according to a conventional example.

Conventionally, however, angles are provided at the boundaries between the bottom surfaces 2517 and the lateral surfaces 2518, and the problem used to occur that the toner, in particular very finely powdered toner, accumulates at the boundaries. The following is an explanation of this problem with reference to FIG. 18. FIG. 18 is an explanatory diagram illustrating the problem that occurs in the depression portions 2516 of the developing roller 510 according to a conventional example.

As shown in FIG. 18, if there is an angle at the boundary between the flat bottom surfaces 2517 and the lateral surfaces 2518 adjacent to the bottom surfaces in the depression portions 2516, the toner, in particular very finely powdered toner, does not come into contact with toner of a relatively large volume particle diameter (hereafter, referred to as "large particle-diameter toner") that rolls through the depression portions 2516, and therefore it is not discharged by this large particle-diameter toner and as a result accumulates in the depression portions 2516.

Figure 19:
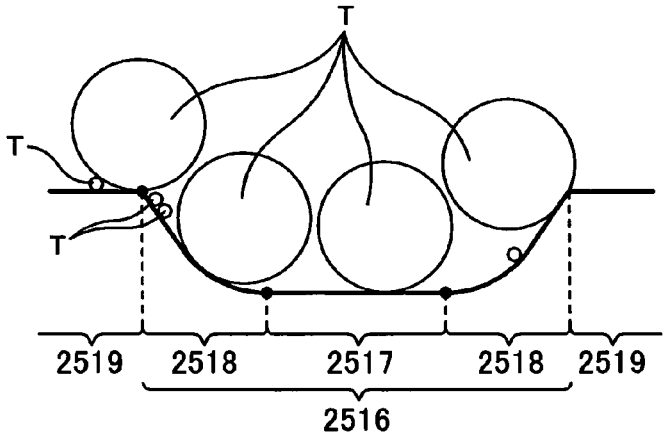
FIG. 19 is an explanatory diagram illustrating the advantageous effect of the depression portion 2516 of the developing roller 510 according to the third embodiment.

On the other hand, the depression portions 2516 of the developing roller 510 according to this embodiment solve this problem. This is described with reference to FIG. 19. FIG. 19 is a diagram illustrating the advantageous effect of the depression portions 2516 of the developing roller 510 according to this embodiment.

As shown in FIG. 19, the depression portions 2516 are provided with roundings whose radius of curvature R is equal to or more than half the volume average particle diameter of the toner, at the boundaries between the bottom surfaces 2517 and the lateral surfaces 2518. By using the depression portions 2516 with such a structure, most of the large particle-diameter toner rolls while contacting the boundaries, therefore the toner smaller than the large particle-diameter toner can be suitably discharged out of the depression portions 2516. Consequently, it becomes possible to suitably suppress the accumulation of the toner.

It should be noted that in this embodiment, as shown in FIG. 17, the boundaries between the lateral surfaces 2518 adjacent to the flat bottom surfaces 2517 and the non-depression portions 2519 adjacent to the lateral surfaces provided in the depression portions 2516 is provided with roundings whose radius of curvature R is equal to or more than half the volume average particle diameter of the toner, but there is no limitation to this. For example, it is also possible that the boundaries between the non-depression portions 2519 and the lateral surfaces 2518 in FIG. 17 are angular. However, in this case, there is the risk that stress from the angles concentrate locally on the toner, and the toner is deformed due to this stress.

On the other hand, if the boundaries between the lateral surfaces 2518 and the non-depression portions 2519 are provided with roundings whose radius of curvature R is equal to or more than half the volume average particle diameter of the toner, then it is possible to disperse the force acting on the toner at the boundary and suppress deformation of the toner. In this point, this embodiment is more preferable.

Other Depression Portion Shapes

Figure 20:
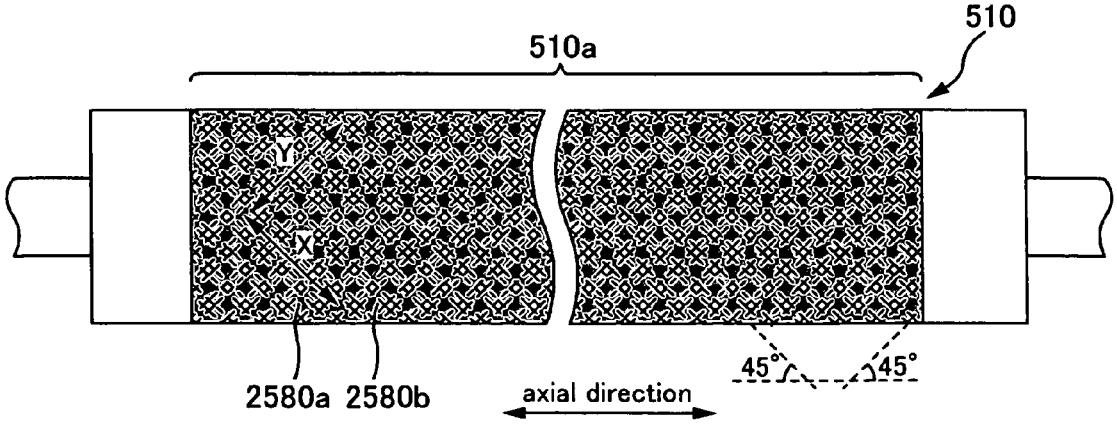
FIG. 20 is a schematic front view of the developing roller 510 according to a modified example of the third embodiment.
Figure 21:
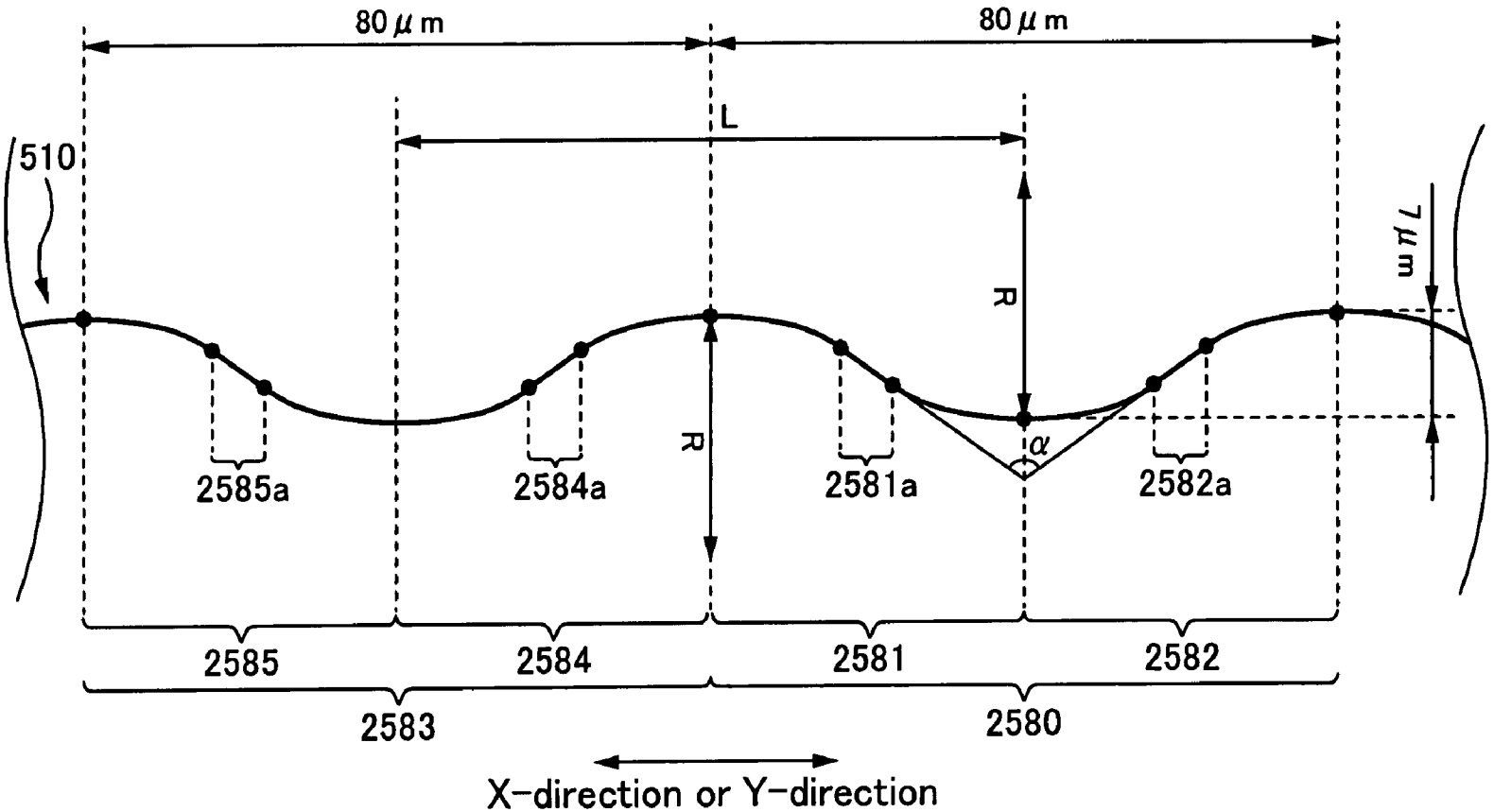
FIG. 21 is a schematic view showing the cross-sectional shape of the depression portion 2580 according to a modified example of the third embodiment.

In the foregoing, the depression portions were described that include the flat bottom surfaces 2517 and the lateral surfaces 2518 adjacent to the bottom surfaces, serving as the depression portions that suitably suppress the accumulation of the toner, and in which the boundaries between the bottom surfaces and the lateral surfaces are provided with roundings whose radius of curvature R is larger than half the volume average particle diameter of the toner (main example of the second embodiment). However, this main example is merely an example of the depression portions suitably suppressing the accumulation of toner, and other examples are also conceivable. In this section, an explanation of the depression portions having different shapes than in the main example is given (modified example of the second embodiment). FIG. 20 is a diagram corresponding to FIG. 16, and is a schematic front view of the developing roller 510 according to this modified example. FIG. 21 is a schematic view showing the cross-sectional shape of the depression portions 2580 according to this modified example, and shows a cross section taken along the direction marked as symbol X or Y in FIG. 20. It should be noted that the scale of the depression portions 2580 and the like in FIGS. 20 and 21 is different from the actual scale.

The depression portions 2580 of this modified example have sections 2581*a* and 2582*a* that are slanted in a planar shape (hereafter, referred to as "planar slanted sections") within the center region 510*a* of the surface of the developing roller 510, and are provided with first lateral surfaces 2581 and second lateral surfaces 2582 that face each other.

In this modified example, there is nothing corresponding to the non-depression portions 2519 in the center region 510*a* of the surface of the developing roller 510. As shown in FIG. 21, the depression portions 2580 are adjacent to the other depression portions 2583 next to them. That is to say, the first lateral surface 2581 is adjacent to a third lateral surface 2584 at the top (towards the aperture side) of the depression portions 2580 and other depression portions 2583. It should be noted that the other depression portions 2583 include third lateral surfaces 2584 and fourth lateral surfaces 2585 facing each other, and like the depression portions 2580, the third lateral surfaces 2584 and the fourth lateral surfaces 2585 include planar slanted sections 2584*a* and 2585*a*, respectively.

In this modified example, the aperture width and the depth of the depression portions 2580 are about 80 μm and about 7 μm, respectively, as is shown in FIG. 21. Moreover, the groove angle of the depression portions 2580 (the angle marked by symbol α in FIG. 21) is about 110°. Furthermore, roundings whose radius of curvature R is equal to or more than half the volume average particle diameter of the toner particles is provided at the boundaries between the first lateral surfaces 2581 and the second lateral surfaces 2582.

Furthermore, roundings whose radius of curvature R is equal to or more than half the volume average particle diameter of the toner particles are also provided at the boundaries between the first lateral surfaces 2581 and the third lateral surfaces 2584, but there is no limitation to this. For example, it is also possible that the boundaries between the first lateral surfaces 2581 and the third lateral surfaces 2584 in FIG. 21 are angular. However, with regard to the above-explained advantage of suppressing toner deformation, the present modified example is more preferable.

It should be noted that in the present modified example, as in the actual example, the depression portions 2580 formed in the center regions 510*a* of the surface of the developing roller 510 form first grooves 2580*a* and second grooves 2580*b* of different winding directions, as shown in FIG. 20 and FIG. 21. That is to say, in FIG. 20, the depression portions 2580 lined up in the cross section in X direction belong to the first grooves 2580*a*, and the depression portions 2580 lined up in the cross section in the Y direction belong to the second grooves 2580*b*.

Moreover, here, the angles that the longitudinal direction of the first grooves 2580*a* and the second grooves 2580*b* respectively define with the axial direction of the developing roller 510 are each about 45°, as shown in FIG. 20. The helical pitches of the first grooves 2580*a* and the second grooves 2580*b* (that is, the length marked by symbol L in FIG. 21) are equidistant.

It should be noted that for the round dies 650, 652 used when the through-feed rolling process is performed in order to realize the developing roller 510 according to the present modified example, dies may be used that have a rounding whose radius of curvature is larger than half the volume average particle diameter of the toner at the edge portion of their projection portions 650*a*, 652*a* (for example rounded dies), as in the present example.

Fourth Embodiment

Figure 22:
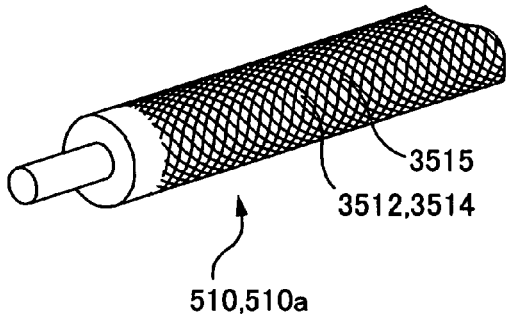
FIG. 22 is a schematic perspective view of the developing roller 510 according to a fourth embodiment.
Figure 23:
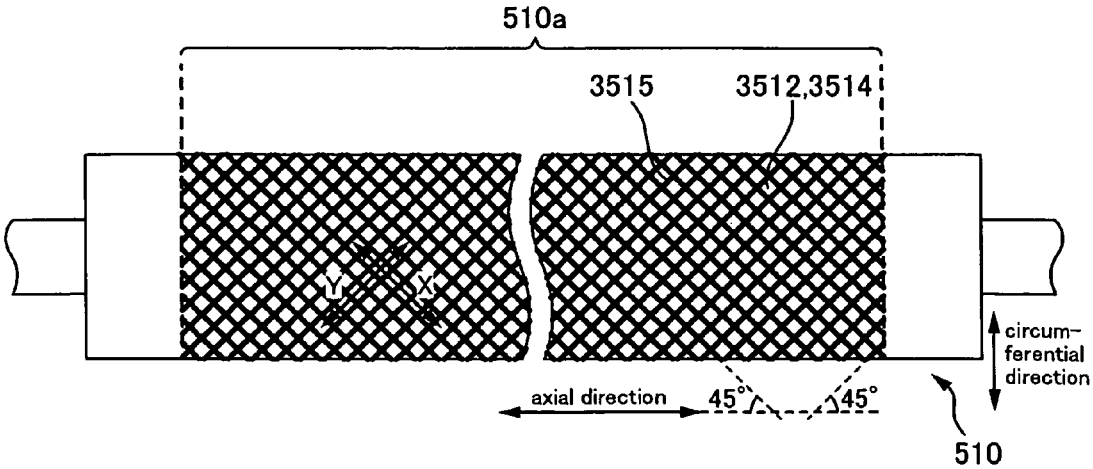
FIG. 23 is a schematic front view of the developing roller 510 according to the fourth embodiment.
Figure 24:
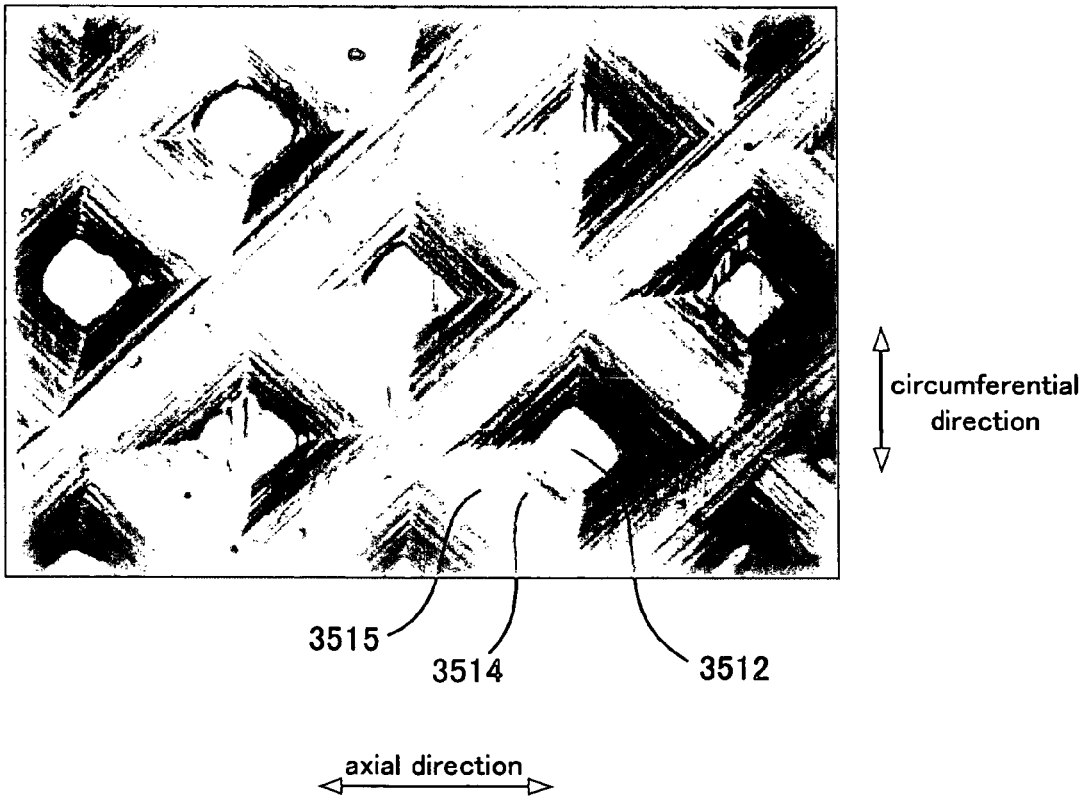
FIG. 24 is an enlarged view of the center region 510*a* of the developing roller 510 according to the fourth embodiment.
Figure 25:
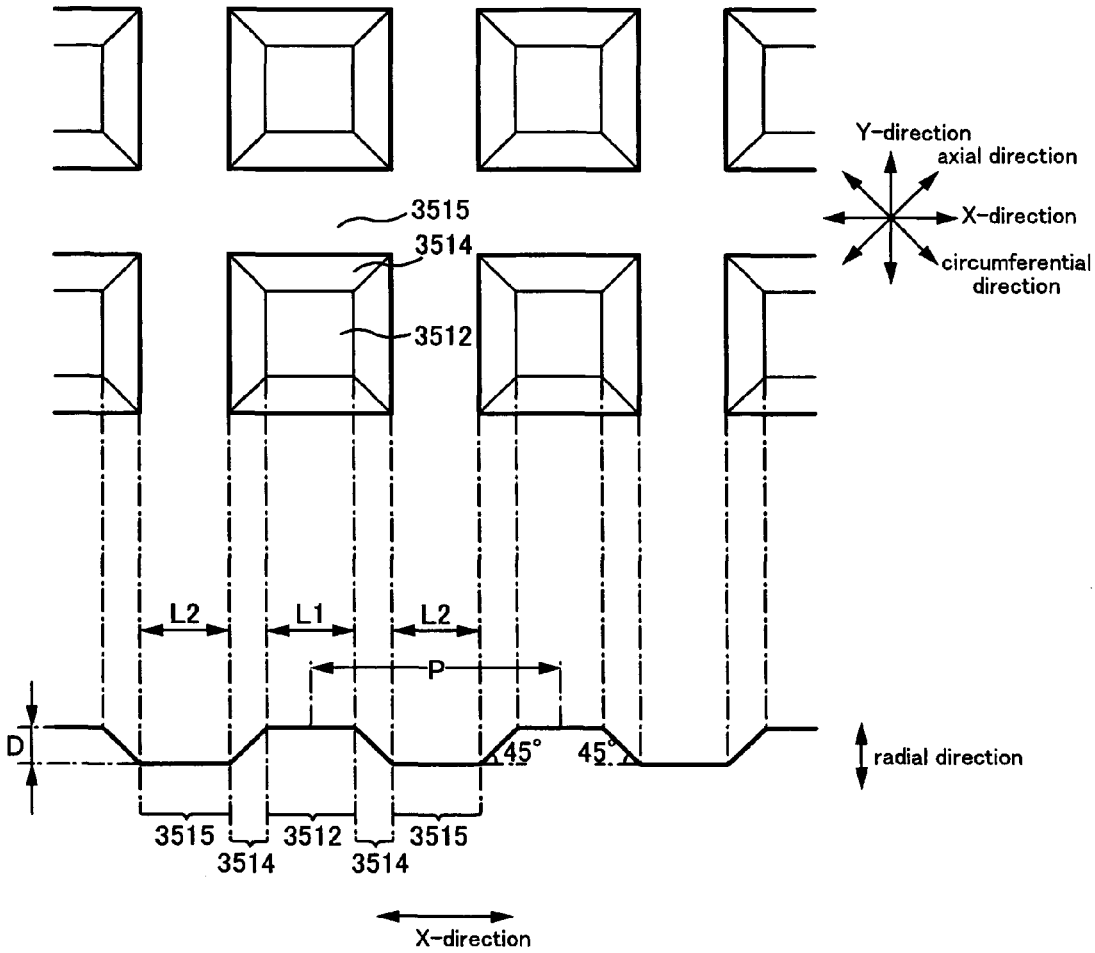
FIG. 25 is a schematic view showing the shape of the projection portions 3512 and the depression portions 3515 according to the fourth embodiment.

Configuration Example of Developing Roller 510 of Developing Device According to Fourth Embodiment Referring to FIGS. 22 to 25, the following is an explanation of a configuration example of the developing roller 510 of the developing device according to a fourth embodiment. FIG. 22 is a schematic perspective view of the developing roller 510. FIG. 23 is a schematic front view of the developing roller 510. FIG. 24 is an enlarged view of the center region 510*a* of the developing roller 510. FIG. 25 is a schematic view showing the shape of a projection portion 3512 and a depression portion 3515 and the like, and the upper diagram in FIG. 25 is a schematic representation of the enlarged view shown in FIG. 24. Furthermore, the lower diagram of FIG. 25 shows the cross-sectional shape of the projection portion 3512 and the depression portion 3515. For illustrative reasons, the scale of the projection portion 3512 and the like in FIGS. 22, 23, and 25 is different from the actual scale.

The developing roller 510 of the developing device according to this fourth embodiment bears the toner T and transports it to the developing position opposite the photoconductor 20. The developing roller 510 is a member made of the aluminum alloy or the iron alloy and the like.

As shown in FIGS. 23 to 25, the developing roller 510 has projection portions 3512, lateral sections 3514 and depression portions 3515 on the surface of its center region 510*a*, in order to suitably bear the toner T (it should be noted that the projection portions 3512, lateral sections 3514, and depression portions 3515 all display the function of toner-bearing sections for bearing toner).

The projection portions 3512 are the highest regions within the center region 510*a*, and have a square planar shape, as shown in the upper diagram of FIG. 25. The length L1 of one side of the square projection portions 3512 (see lower diagram in FIG. 25) is about 28 μm.

Moreover, the value of the ten-point average roughness Rz (according to JIS B 0601-1994) of the projection portions 3512 depends strongly on the direction of the average line of the roughness curve when determining this ten-point average roughness Rz. Explaining this in more detail, the value of the ten-point average roughness Rz of the projection portion 3512 is largest, at a value of about 2 μm, when taking the direction along the axial direction of the developing roller 510 as the direction of the average line. On the other hand, the ten-point average roughness Rz of the projection portion 3512 is smallest, at a value of about 0.5 μm, when taking the direction along the circumferential direction of the developing roller 510 as the direction of the average line. That is to say, in the axial direction, the surface of the projection portions 3512 is rough, whereas in the circumferential direction, it is not very rough (this is expressed by the vertical stripes that can be observed in the projection portions 3512 shown in FIG. 24).

The lateral sections 3514 are slanted surfaces connecting the projection portions 3512 and the depression portions 3515, and as shown in the upper diagram of FIG. 25, four lateral sections 3514 are provided in correspondence with the four sides of the above-described square projection portions 3512. As shown in the lower diagram of FIG. 25, the inclination angle of the lateral sections 3514 is about 45°.

And as shown in FIGS. 22 to 25, many sets of (groups of) the projection portion 3512 and the four lateral sections 3514 are arranged regularly in a lattice-like arrangement on the surface of the center region 510*a* of the developing roller 510. It should be noted that the pitch P of the projection portions 3512 (see the lower diagram in FIG. 25) is about 80 μm.

The depression portions 3515 are the lowest portions within the center region 510*a*, and as shown in FIGS. 22 to 25, they are formed regularly in a lattice-like arrangement, surrounding the projection portions 3512 and the four lateral sections 3514 on all four sides. The depression portions 3515 are provided helically, such that their longitudinal directions (in FIG. 25, these directions are marked as symbol X and Y) define an angle of about 45° with the axial direction of the developing roller 510. And the width L2 (the length in the transverse direction) of the depression portions 3515 (see lower diagram in FIG. 25) is about 28 μm.

Moreover, the depth D of the depression portions 3515 (that is, the distance from the projection portions 3512 to the depression portions 3515 in the radial direction of the developing roller 510, see lower diagram in FIG. 25) is about 12 μm. It should be noted that in this embodiment, the toner T is granular (particulate) and the volume average particle diameter of the toner T is about 7 μm, therefore the depth D of the depression portions 3515 is equal to or more than the volume average particle diameter but equal to or less than twice the volume average particle diameter.

Moreover, different than in the case of the above-noted projection portions 3512, the value of the ten-point average roughness Rz of the depression portions 3515 is substantially the same value regardless of the direction of the average line. This value is about 0.5 μm. Thus, the maximum value of the ten-point average roughness Rz of the depression portion 3515 (0.5 μm) is smaller than the maximum value of the ten-point average roughness Rz of the projection portion 3512 (2 μm). It should be noted that the maximum value of the ten-point average roughness Rz of the projection portion 3512 is equal to or less than the volume average particle diameter of the toner T.

Furthermore, the surface of the center region 510*a*, which is provided with the above-described projection portions 3512, lateral sections 3514 and depression portions 3515, is subjected to electroless Ni—P plating.

Further, such developing roller 510 can be manufactured as follows, using the method explained in the section regarding the method for manufacturing the developing roller 510.

That is, as shown in FIG. 13D, the surface of the pipe member 600 to which the flanges 604 have been press-fitted is subjected to centerless grinding, but in this centerless grinding process, the pipe member is clamped by a plurality of rotating grindstones and ground in this state along the circumferential direction by the grindstones. Therefore, the above-described vertical stripes along the circumferential direction are formed in the surface of the pipe member 600, and the ten-point average roughness Rz in the axial direction becomes larger than the ten-point average roughness Rz in the circumferential direction.

The centerless grinding is performed across the entire surface, and the value of the ten-point average roughness Rz of the entire surface after the centerless grinding is about 2 μm when taking the direction along the axial direction as the direction of the average line of the roughness curve when determining the ten-point average roughness Rz, whereas it is about 0.5 μm when taking the direction along the circumferential direction as the direction of this average line. It should be noted that the ten-point average roughness Rz of the groove formed by the through-feed rolling (that is, the portion corresponding to the above-noted depression portions 3515 and the lateral sections 3514; see the lower diagram in FIG. 25) is about 0.5 μm.

Advantages of the Developing Device According to the Fourth Embodiment

As described above, the developing roller 510 according to the fourth embodiment has on its surface the depression portions 3515 and the projection portions 3512 that are arranged regularly, and the maximum value of the ten-point average roughness Rz of the depression portion 3515 (0.5 μm) is smaller than the maximum value of the ten-point average roughness Rz of the projection portions 3512 (2 μm). This makes it possible to suppress density irregularities in the toner image from occurring.

That is to say, as explained above, the development of the latent image borne by the photoconductor 20 with the toner that is borne on the surface of the developing roller 510 is performed in a state in which the developing roller 510 faces the photoconductor 20, and at that time, a situation may occur in which the distance between the toner borne in the depression portions 3515 of the developing roller 510 and the latent image borne by the photoconductor 20 becomes larger than the distance between the toner borne on the projection portions 3512 and the latent image.

In such a situation, since the ratio of the amount of toner reaching the photoconductor 20 to the amount of toner removed from the surface (i.e. the depression portions 3515 or projection portions 3512) of the developing roller 510 is smaller for the depression portions 3515 than for the projection portions 3512, so that the density of the toner image formed with the toner borne by the depression portion 3515 on the photoconductor 20 becomes lighter than the density of the toner image formed with the toner borne by the projection portion 3512 on the photoconductor 20, and there is a risk that density irregularities occur in the toner image.

On the other hand, in the developing roller 510 according to the fourth embodiment, since the maximum value of the ten-point average roughness Rz of the depression portions 3515 is smaller than the maximum value of the ten-point average roughness Rz of the projection portions 3512 (that is to say, the depression portion 3515 is smoother whereas the projection portion 3512 is rougher), when the latent image is developed, the amount of the toner that is removed from the depression portion 3515 becomes larger than the amount of the toner that is removed from the projection portion 3512. That is to say, in accordance with the developing roller 510 according to this embodiment, in the depression portion 3515, where the ratio of the toner amount reaching the photoconductor 20 to the toner amount removed from the surface of the developing roller 510 is smaller, the amount of toner removed from this surface (the depression portion 3515) can be increased, and in the projection portions 3512 where this ratio is large, the amount of the toner removed from the surface (the projection portion 3512) can be reduced, and therefore it becomes possible to equalize the amount of the toner reaching the photoconductor 20 after leaving the depression portion 3515 with the amount of toner reaching the photoconductor 20 after leaving the projection portion 3512.

Consequently, the above-described problem that the density of the toner image formed on the photoconductor 20 with the toner borne by the depression portion 3515 becomes lighter than the density of the toner image formed on the photoconductor 20 with the toner borne by the projection portion 3512, resulting in density irregularities in the toner image can be suppressed.

Other Aspects of the Fourth Embodiment

In the foregoing, the ten-point average roughness Rz of the projection portions 3512 was explained to be maximal when the direction along the axial direction of the developing roller 510 was taken as the direction of the average line of the roughness curve when determining the ten-point average roughness Rz, but there is no limitation to this. For example, it may also be set to be maximal when a direction along the circumferential direction of the developing roller 510 is taken as the direction of the average line.

Moreover, in the above-described embodiment, the ten-point average roughness Rz of the projection portion 3512 was explained to be minimal when the direction along the circumferential direction of the developing roller 510 was taken as the direction of the average line of the roughness curve when determining the ten-point average roughness Rz, but there is no limitation to this. For example, it may also be set to be maximal when a direction along the circumferential direction of the developing roller 510 is taken as the direction of the average line.

When the developing roller 510 is rotated around its center axis, the toner borne on the surface in the center region 510*a* of the developing roller 510 moves along the circumferential direction of the developing roller 510, however, when a direction along this circumferential direction is taken as the direction of the average line, and the phenomenon that the toner moving along the circumferential direction becomes stuck at the projection portions 3512 if the ten-point average roughness Rz of the projection portion 3512 is large will become conspicuous.

Consequently, the occurrence of this phenomenon is suitably suppressed and the toner transfer characteristics will be improved if the ten-point average roughness Rz of the projection portion 3512 is made minimal when the direction of the average line is set to a direction along the circumferential direction of the developing roller 510. For this reason, the above-described embodiment is more preferable.

Moreover, in the above-described embodiment, the maximum value of the ten-point average roughness Rz of the projection portion 3512 is equal to or less than the volume average particle diameter of the toner, but there is no limitation to this, and it is also possible to make the maximum value of the ten-point average roughness Rz of the projection portion 3512 greater than the volume average particle diameter of the toner.

However, with regard to making it difficult for the toner to become stuck at the projection portion 3512 and improving the transfer characteristics of the toner, the above-described embodiment is preferable.

Fifth Embodiment

Relation Between the Projection Portions of the Developing Roller of a Developing Device According to the Fifth Embodiment and the Wall Regions of the Toner Supply Roller of this Developing Device As noted above, the developing roller 510 is supplied with toner by the toner supply roller 550, and the toner that remains after the development of the latent image on the photoconductor 20 is scraped off by the toner supply roller 550. At this time, the toner contained in the pore 550*c* (see FIGS. 26 to 28) of the toner supply roller 550 is supplied mainly to the surface of the developing roller 510, and the toner remaining on the surface of the developing roller 510 contacting the wall region 550*d* surrounded by a plurality of the pores 550*c* (see FIGS. 26 to 28) is scraped off. Now, many square projection portions 4512 are formed on the surface of the developing roller 510. Since the latent image on the photoconductor 20 is developed by the toner borne at the locations facing the developing roller 510, both the groove portions as well as the projection portions 4512 of the developing roller 510 need to bear the toner.

However, if the entire surface of a projection portion 4512 of the developing roller 510 is covered by the wall region 550*d* of the toner supply roller 550, when the developing roller 510 contacts the toner supply roller 550, the toner on the surface of that projection portion 4512 whose entire surface is covered is scraped off. Therefore, when the configuration is such that the entire surface of the projection portion 4512 of the developing roller 510 is covered by the wall region 550*d* of the toner supply roller 550, there is the risk that locations at which no toner is borne by the surface of the developing roller 510 is generated, and when the latent image is developed, there are locations that are not developed by the toner image, so that locations with lower density occur, resulting in density irregularities.

Figure 26:
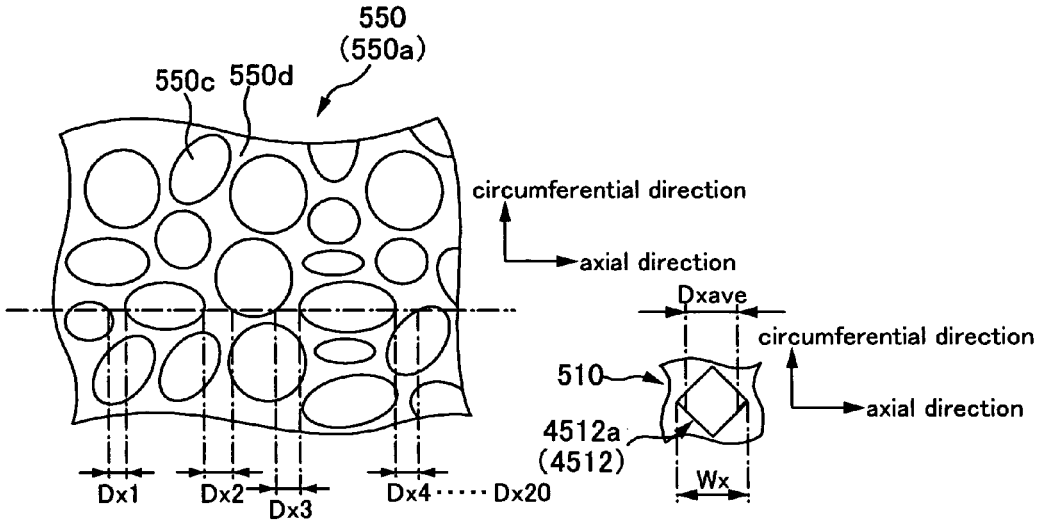
FIG. 26 is a (first) schematic view illustrating the advantageous effect of the developing device according to the fifth embodiment.

Accordingly, in the developing device according to this embodiment, the average distance with respect to the axial direction of the toner supply roller 550 between the apertures of the pores 550*c* of the toner supply roller 550 is smaller than the maximum width in axial direction of the top surface 4512*a* of the projection portions 4512 of the developing roller 510. This is explained with reference to FIG. 26. FIG. 26 is a schematic view illustrating the advantageous effect of the developing device according to the fifth embodiment.

The left drawing in FIG. 26 shows a schematic view of the enlarged cross section of a roller section 550*a* of the toner supply roller 550. Here, the distance, with respect to the axial direction of the toner supply roller 550, between the aperture of the pore 550*c* in the toner supply roller 550 are for example, the distances marked by symbols Dx1, Dx2, Dx3, and Dx4 in FIG. 26, and the average distance Dxave of these distances is the average value of a plurality (for example 20) of these distances Dx1, Dx2, . . . , Dx20 (it should be noted that in FIG. 26, the distances Dx1, Dx2, . . . , Dx20 are arranged on one straight line, but they do not necessarily have to be the distances arranged on one straight line). In the toner supply roller 550 according to this embodiment, this average distance Dxave is about 40 to 50 μm.

On the other hand, one of the top surfaces 4512*a* of a plurality of the projection portions 4512 is shown in the right figure of FIG. 26. In the developing roller 510 according to this embodiment, the maximum width, with respect to the axial direction, of the top surface 4512*a* of the projection portion 4512 (this maximum width is marked as symbol Wx in FIG. 26) is about 80 μm.

Thus, in the developing device according to this embodiment, the average distance Dxave is smaller than the maximum width Wx, which has the following advantages. That is, with this developing device, when the wall region 550*d* between the apertures of the pores 550*c* of the toner supply roller 550 contact the top surface 4512*a* of the projection portion 4512, it is possible to avoid the top surface 512*a* being completely covered by the wall region 550*d* in the axial direction of the toner supply roller 550 (in the right drawing in FIG. 26, the hatching indicates an example of a portion on the top surface 4512*a* that is not covered by the wall region 550*d*). Therefore, when the portion of developing roller 510 contacting with the toner supply roller is removed from the toner supply roller 550 and the toner borne by the developing roller 510 is charged and its layer thickness is regulated by the regulating blade 560, the toner is suitably borne on the top surface 4512*a* of the projection portion 4512.

Moreover, even if toner is borne only by a portion of the top surfaces 4512*a* of the projection portions 4512, the toner thickness is regulated by the regulating blade 560, and the toner that is unevenly distributed on the top surface 4512*a* of the projection portion 4512 is distributed evenly on the top surface 4512*a*. In other words, the toner that is unevenly borne by the top surface 4512*a* is spread over a wider area of the top surface 4512*a*. Thus, when the latent image is developed, occurrence of locations where the toner image is not developed as well as density irregularities occurring at locations where the density is low can be suitably avoided.

Figure 27:
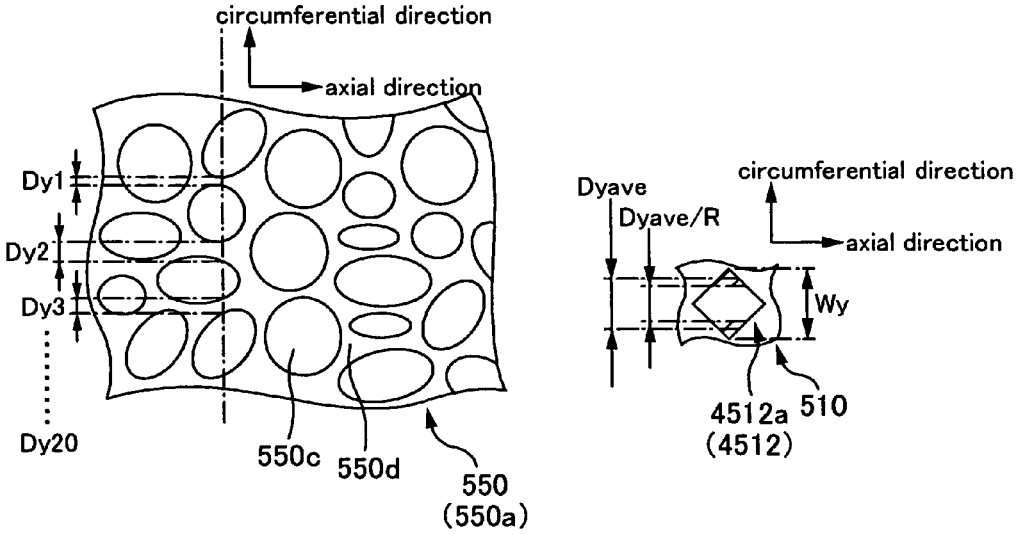
FIG. 27 is a (second) schematic view illustrating the advantageous effect of the developing device according to the fifth embodiment.

Next, the relation between the top surface 4512*a* of the projection portion 4512 and the wall region 550*d* in the circumferential direction of the developing roller 510 and the toner supply roller 550 is discussed with reference to FIG. 27. FIG. 27 is a schematic view illustrating the advantageous effect of the developing device according to the fifth embodiment.

Like FIG. 26, the left drawing in FIG. 27 shows a schematic magnification of the cross section of the roller section 550*a* of the toner supply roller 550. Here, the distance, in the circumferential direction of the toner supply roller 550, between the aperture of the pore 550*c* of the toner supply roller 550 is, for example, the distances marked by symbols Dy1, Dy2, and Dy3 in FIG. 27, and the average distance Dyave of these distances is the average value of a plurality (for example 20) of these distances Dy1, Dy2, . . . , Dy20. In the toner supply roller 550 according to this embodiment, this average distance Dyave is about 40 to 50 μm, just like the above-noted average distance Dxave.

On the other hand, as in FIG. 26, one of the top surfaces 4512*a* of the plurality of projection portions 4512 is shown in the right drawing of FIG. 27. In the developing roller 510 according to this embodiment, the maximum width, with respect to the circumferential direction, of the top surface 4512*a* of the projection portion 4512 (this maximum width is marked as symbol Wy in FIG. 27) is about 80 μm, just like the above-noted maximum width Wx.

Also for the circumferential direction, if the average distance Dyave and the maximum width Wy fulfill such relationship that it can avoided that the top surface 4512*a* is completely covered by the wall region 550*d* in the circumferential direction of the toner supply roller 550, even when the top surface 4512*a* of the projection portion 4512 come in contact with the wall region 550*d* between the aperture of the pore 550*c* of the toner supply roller 550, the above-mentioned effect, that is, the effect of suitably avoiding the occurrence of locations that are not developed to the toner image and occurrence of locations with low density which leads to density irregularities, can be attained when developing the latent image.

Here, regarding this relationship, the situation with regard to the circumferential direction is slightly different than the situation with regard to the axial direction. That is to say, in this embodiment, as described above, there is a rotation speed difference between the toner supply roller 550 and the developing roller 510, and the speed with which the surface of the toner supply roller 550 moves when the toner supply roller 550 rotates is about 1.5 times the speed with which the surface of the developing roller 510 rotates when the developing roller 510 rotates. In this situation, while the surface of the toner supply roller 550 advances by the average distance Dyave, for example, the surface of the developing roller 510 advances only by a distance obtained by dividing the average distance Dyave by the ratio R of the traveling speed of the surface of the toner supply roller 550 to the traveling speed of the surface of the developing roller 510 (that is, 1.5). Consequently, with regard to the circumferential direction, if the value obtained by dividing the average distance Dyave by the ratio R of the traveling speed of the surface of the toner supply roller 550 to the traveling speed of the surface of the developing roller 510 (that is, 1.5) is smaller than the maximum width Wy in the circumferential direction of the top surface 4512*a* of the projection portion 4512 of the developing roller 510, then the above-noted effect can be attained.

In this embodiment, the value obtained by dividing the average distance Dyave by the ratio R of the traveling speed of the surface of the toner supply roller 550 to the traveling speed of the surface of the developing roller 510 (that is, 1.5) is about 26 to 33 μm, and this value is smaller than the maximum width Wy (about 80 μm). Therefore, even when the wall region 550*d* between the apertures of the pores 550*c* of the toner supply roller 550 contact the top surface 4512*a* of the projection portion 4512, it can be avoided that the top surface 4512*a* is completely covered by the wall region 550*d* in the circumferential direction of the toner supply roller 550 (in the right drawing in FIG. 27, the hatching indicates an example of portion on the top surface 4512*a* that is not covered by the wall region 550*d*). Consequently, when the latent image is developed, occurrence of the location where the toner image is not developed as well as density irregularities occurring at locations where the density is low can be avoided appropriately.

Figure 28:
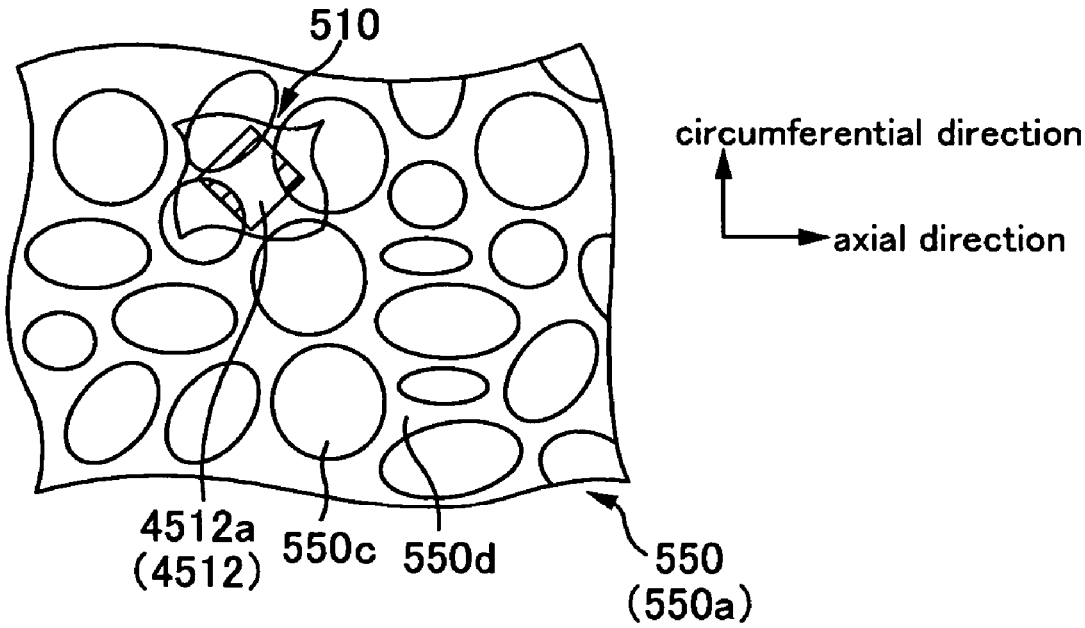
FIG. 28 is a (third) schematic view illustrating the advantageous effect of the developing device according to the fifth embodiment.

Furthermore, as shown in FIG. 28, the developing device according to this embodiment is formed such that when the projection portion 4512 of the developing roller 510 contacts against the wall region 550*d* of the toner supply roller 550, at least a portion of the top surface 4512*a* of the projection portion 4512 protrudes from the wall region 550*d* enclosed by a plurality of the pores 550*c* (in FIG. 28, the portion of the top surface 4512*a* that protrude from the wall region 550*d* are hatched).

Consequently, in this developing device, even when the wall region 550*d* between the apertures of the pores 550*c* of the toner supply roller 550 contact the top surface 4512*a* of the projection portion 4512, it can be suitably avoided that the top surface 4512*a* is completely covered by the wall region 550*d*. Consequently, when the latent image is developed, occurrence of the location where the toner image is not developed as well as density irregularities occurring at locations where the density is low can be avoided appropriately.

It should be noted that FIG. 28 is a schematic view illustrating the advantageous effect of the developing device according to the fifth embodiment, and shows how the projection portion 4512 of the developing roller 510 is in contact with the wall region 550*d* of the toner supply roller 550.

Moreover, as described above, the layer thickness of the toner particle borne on the surface of the developing roller 510 is regulated by a planar surface of the regulating blade 560. Consequently, the toner particles borne on the surface of the developing roller 510 are not completely scraped off by the regulating blade 560, and it is possible to spread the toner particles borne only by a portion of the top surface of the projection portion 4512 evenly over the top surface of the projection portion 4512 with the developing blade 560.

Configuration of Image Forming System Etc.

Next, an embodiment of an image forming system as an example of an embodiment of the present invention is described with reference to the drawings.

Figure 29:
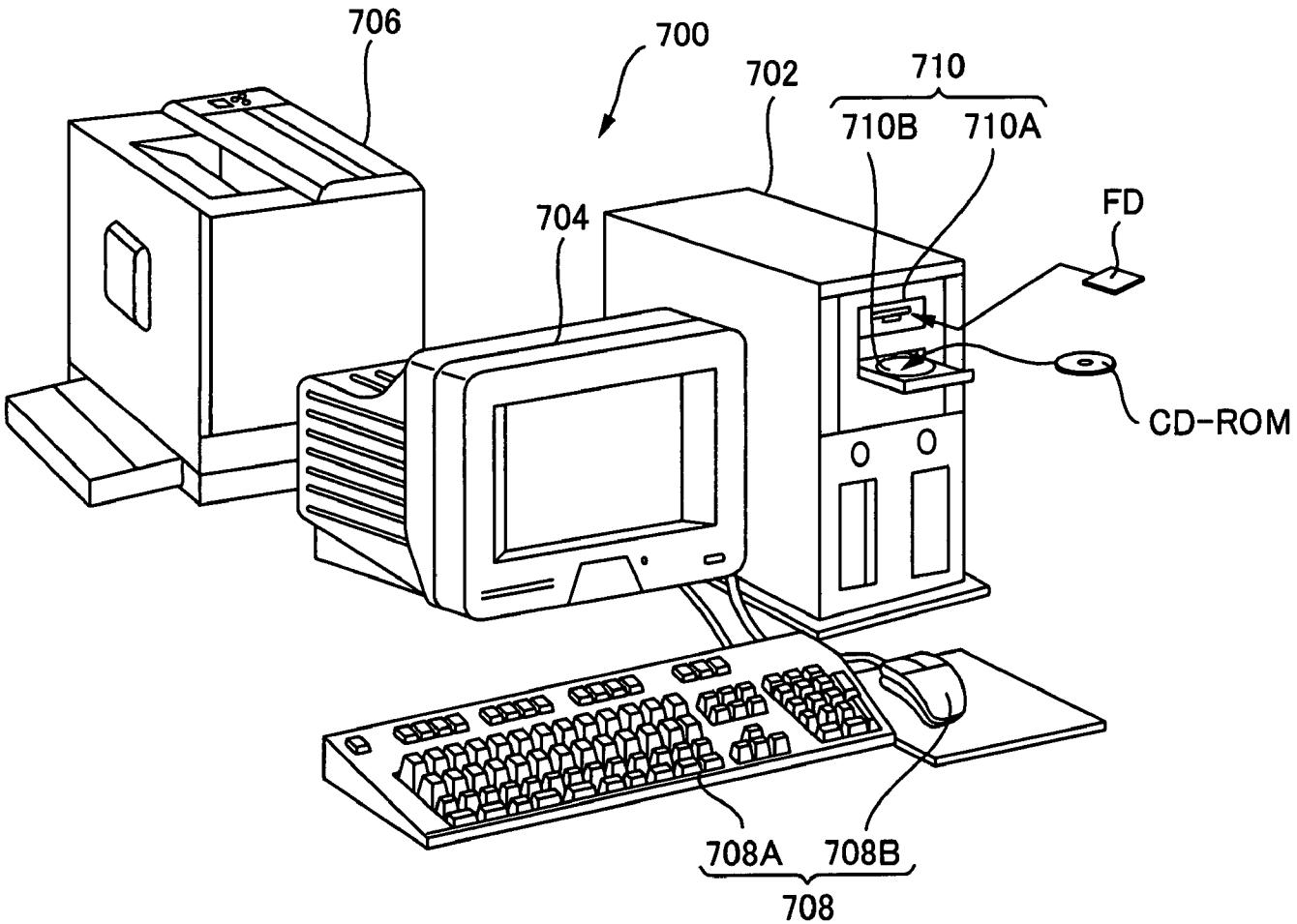
FIG. 29 is an explanatory diagram showing the external configuration of an image forming system.

FIG. 29 is an explanatory diagram showing the external configuration of the image forming system. An image forming system 700 is provided with a computer 702, a display device 704, a printer 706, input devices 708, and reading devices 710. In this embodiment, the computer 702 is contained within a mini-tower type housing, but there is no limitation to this. A CRT (cathode ray tube), a plasma display, a liquid crystal display device or the like is generally used as the display device 704, but there is no limitation to this. As the printer 706, the printer described above is used. In this embodiment, the input devices 708 are a keyboard 708A and a mouse 708B, but there is no limitation to these. In this embodiment, a flexible disk drive device 710A and a CD-ROM drive device 710B are used as the reading device 710, but the reading device 710 is not limited to these, and it may also be a MO (Magnet Optical) disk drive device or a DVD (Digital Versatile Disk) or the like, for example.

Figure 30:
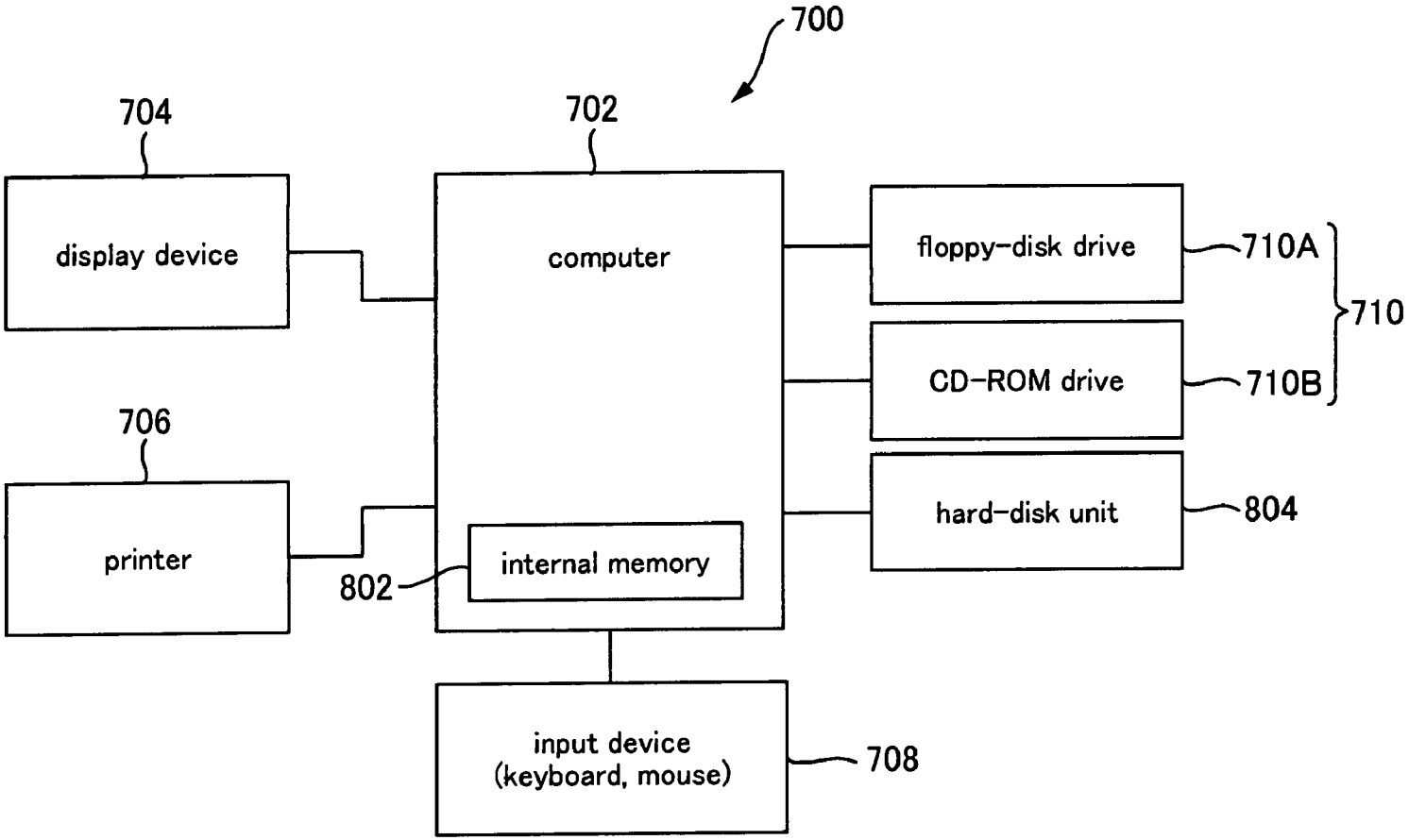
FIG. 30 is a block diagram showing the configuration of the image forming system shown in FIG. 29.

FIG. 30 is a block diagram showing the configuration of the image forming system shown in FIG. 29. An internal memory 802 such as a RAM is provided within the casing containing the computer 702, and furthermore an external memory such as a hard disk drive unit 804 is provided.

Furthermore, in the above explanations, an example was given in which the image forming system is constituted by connecting the printer 706 to the computer 702, the display device 704, the input devices 708, and the reading devices 710, but there is no limitation to this. For example, the image forming system can also be made of the computer 702 and the printer 706, and the image forming system does not have to be provided with any one of the display device 704, the input devices 708, and the reading devices 710.

Furthermore, for example, it is also possible that the printer 706 has some of the functions or mechanisms of each of the computer 702, the display device 704, the input devices 708, and the reading devices 710. For example, the printer 706 may be configured so as to have an image processing section for carrying out image processing, a display section for carrying out various types of displays, and a recording media mount/dismount section for mounting and dismounting recording media storing image data captured by a digital camera and the like.

As an overall system, the image forming system that is thus achieved becomes superior to conventional systems.

What is claimed is:

1. A developing roller comprising, depression portions and projection portions that are arranged regularly at its surface, wherein a maximum value of a ten-point average roughness of the depression portions is smaller than a maximum value of a ten-point average roughness of the projection portions, and the maximum value of the ten-point average roughness of the projection portions is equal to or less than a volume average particle diameter of toner particles.

2. The developing roller according to claim 1, wherein the ten-point average roughness of the projection portions is maximal when a direction along an axial direction of the developing roller is taken as a direction of an average line of a roughness curve when determining the ten-point average roughness.

3. The developing roller according to claim 1, wherein the ten-point average roughness of the projection portions is minimal when a direction along a circumferential direction of the developing roller is taken as the direction of the average line of the roughness curve when determining the ten-point average roughness.

4. A developing device comprising, a developing roller including depression portions and projection portions that are arranged regularly at a surface of the developing roller, wherein a maximum value of a ten-point average roughness of the depression portions is smaller than a maximum value of a ten-point average roughness of the projection portions, and the maximum value of the ten-point average roughness of the projection portions is equal to or less than a volume average particle diameter of toner particles.

* * * * *